US007532838B2

(12) United States Patent
Sakata et al.

(10) Patent No.: US 7,532,838 B2
(45) Date of Patent: May 12, 2009

(54) IMAGE FORMING APPARATUS FOR ATTACHING A CUTTING GUIDE TO IMAGE DATA

(75) Inventors: Satoshi Sakata, Hino (JP); Kazumichi Yamauchi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 379 days.

(21) Appl. No.: 11/339,583

(22) Filed: Jan. 26, 2006

(65) Prior Publication Data

US 2006/0256389 A1 Nov. 16, 2006

(30) Foreign Application Priority Data

May 11, 2005 (JP) ..... 2005-138344

(51) Int. Cl.
*G03G 15/00* (2006.01)

(52) U.S. Cl. ..... 399/82; 399/385

(58) Field of Classification Search ..... 399/82, 399/385

See application file for complete search history.

(56) References Cited

U.S. PATENT DOCUMENTS 5,223,939 A * 6/1993 Imaizumi et al. ..... 399/370
5,631,747 A * 5/1997 Farrell et al. ..... 358/448
5,651,618 A * 7/1997 Tamiya ..... 400/70
2003/0170041 A1 * 9/2003 Katsuyama ..... 399/84
2006/0210296 A1 9/2006 Sakata et al.

FOREIGN PATENT DOCUMENTS

| | | |
|---|---|---|
| EP | 0 762 226 A2 | 3/1997 |
| JP | 9-197738 | 7/1977 |
| JP | 8-241399 | 9/1996 |
| JP | 9-109505 | 4/1997 |
| JP | 11-34424 | 2/1999 |
| JP | 2002-292831 | 10/2002 |

OTHER PUBLICATIONS

European Search Report dated Jan. 5, 2007.

* cited by examiner

*Primary Examiner*—David M Gray
*Assistant Examiner*—Ryan D Walsh
(74) *Attorney, Agent, or Firm*—Finnegan, Henderson, Farabow, Garrett & Dunner, L.L.P.

(57) ABSTRACT

An image forming apparatus includes an image forming section that forms an image on a sheet, based on image data of a job, a sheet ejection tray on which to stack sheets have been formed with an image, and a controller to control image forming, wherein the controller performs control to form an image based on a composite image of image data and a cut guide attached to the image data only on a first image forming page or a last image forming page.

6 Claims, 17 Drawing Sheets

SINGLE SIDED MODE
IMAGE FORMING ORDER: FROM 1ST PAGE

SINGLE SIDED MODE
IMAGE FORMING ORDER: FROM N-TH PAGE

FIG. 8 (a) ATTACHING CUT MARKS TO LAST IMAGE FORMING PAGE
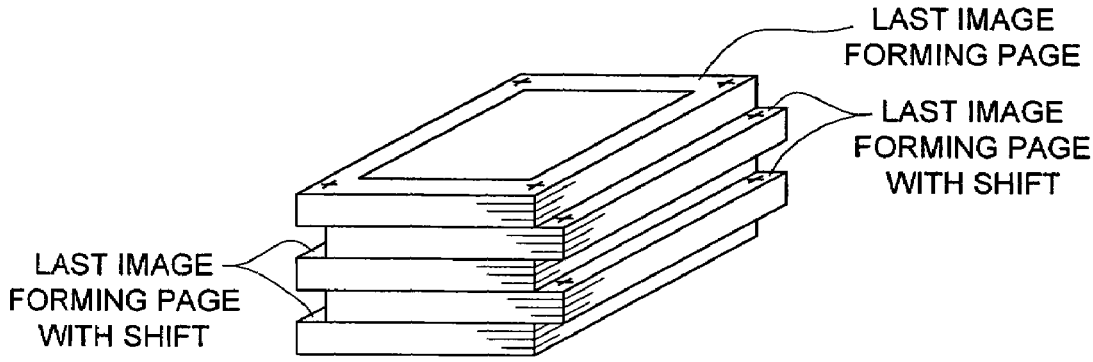
FIG. 8 (b) ATTACHING CUT MARKS TO FIRST IMAGE FORMING PAGE
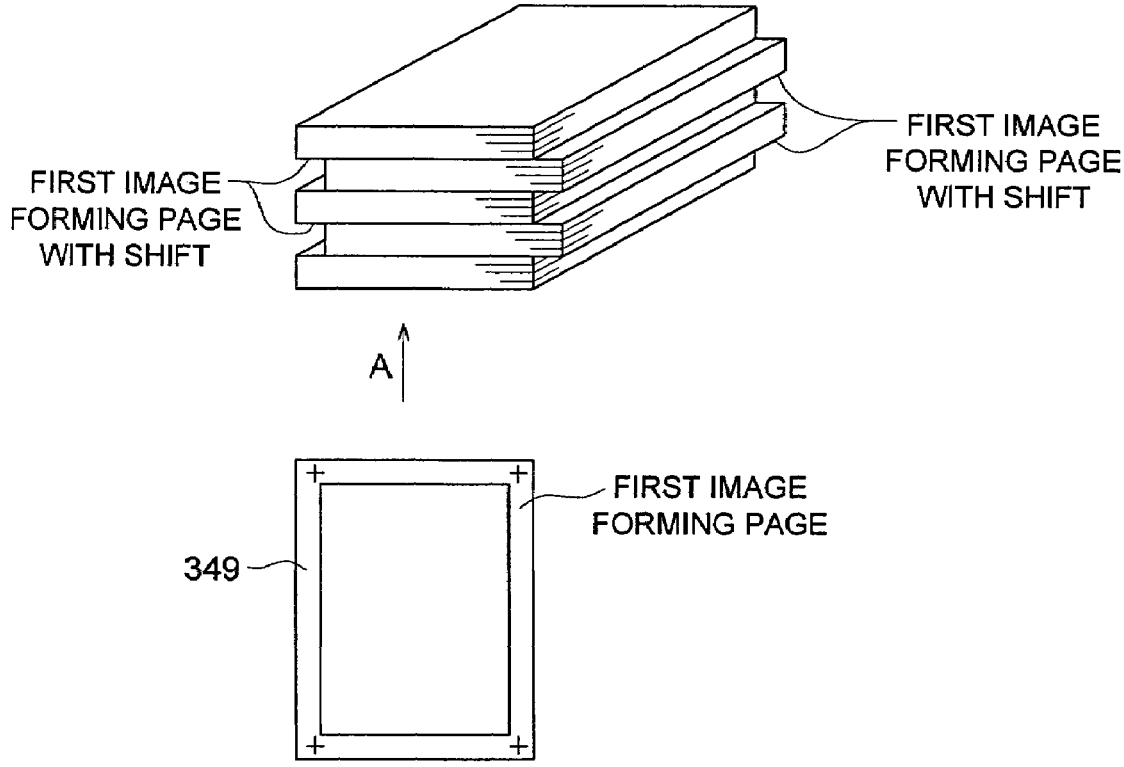
A ARROW VIEW

IMAGE FORMING APPARATUS FOR ATTACHING A CUTTING GUIDE TO IMAGE DATA

FIELD OF THE INVENTION

The invention relates to an image forming apparatus that outputs an image, adding a cut guide to image data.

BACKGROUND OF THE INVENTION

In recent years, image forming is performed on a sheet by an image forming device or the like sometimes in such a manner that cut marks that indicate a cutting position are added to image data for forming an image. This makes easier the sheet cutting task with a sheet cutter after image forming and improves working efficiency.

Cut marks are usually put on each page. That is, in a case of forming an image on both sides of a sheet, cut marks are attached to both sides (for example, see Patent document 1). Patent Document 1 discloses a document making device that performs printing on a single sheet such as a name card or a post card. Specifically, a side of a sheet is used as it is, as a reference side in printing, reducing the number of times of cutting the sheet. By the document making device disclosed in Patent Document 1, cut marks are automatically printed on the pages of both sides of a sheet.

However, in case of printing cut marks on both sides of a sheet, if there is a shift and difference in the position relationship between cut marks on the front side and those on the back side, the marks defining a cutting position, cut marks printed on a side of a sheet may remain when cutting is performed referring to cut marks printed on the other side. If unnecessary cut marks that are images other than image data remain on a sheet, a problem of degrading the image quality is caused.

Further, in Patent Document 2, with respect to the printing field and particularly to an imposition method of carrying out multiple imposition processing of design images in order to prepare printing masters and a ledger sheet design system using such a method, an imposition method has been disclosed that has a setting process to set the parameters of positioning marks. In a point of specific technical view, it has been disclosed that a type is to be set on a register mark setting screen to determine as to whether register marks are to be put on the front side or the back side. In this technology, it is necessary for the user to select and designate whether or not to attach register marks, and hence the procedure is not simple or easy. In addition, in this technology, register marks are to be attached to the front side or the back side, and register marks are to be attached to each sheet when printing is performed on plural pages.

Patent Document 1: TOKKAI No. H9-109505

Patent Document 2: TOKKAI No. H8-241399

However, researches by the inventors proved that a special problem occurs when cut marks are attached by an image forming apparatus that form images using the electro-photographic method. That is, the image forming process in the electro-photographic method includes a heat-and-pressure fixing process that fixes a toner image on a recording sheet by applying heat and pressure. When the sheet is heated during this heat-and-pressure fixing process, the moisture contained in the sheet evaporates due to being heated and also the fiber structure constituting the sheet becomes soft. Thus, a phenomenon occurs that the sheet shrinks after the heat-and-pressure fixing process.

When forming images on both sides of a sheet, even if an image is formed on a first side in a predetermined size, the shrinking phenomenon of the sheet slightly-reduces the size of the sheet and that of the formed image. Next, in image forming on the second side, an image is formed under the same conditions on the second side of the sheet that is the back side opposite to the first side, wherein the front side is in a reduced size and has the image in a reduced size. In this situation, the size of the image on the first side will be smaller than that of the image on the second side, which is caused by the shrinkage of the sheet described above. As a consequence, there will be a gap between the positions of the images on the first and second sides. In case of forming images as cut marks, shrinking of the sheet during the heat-and-pressure fixing process essentially creates a gap between the positions of the images on the first and second sides, even if image forming is attempted to be performed on the same position on the front and back sides. When cutting processing is performed with reference to the cut marks on either the front side or the back side with a gap between the positions of cut marks on the front side and the back side, it is possible that the cut marks that were not referred to remain on the sheet after cutting, and hence the image quality goes down.

Further, in the case of forming images on plural sheets by the electro-photographic method, a transfer process that transfers an image onto a sheet conveyed by conveying rollers is included, wherein variation in the conveyance and transfer timing of the respective sheets can not be avoided, which makes it difficult to form images on the same position of the respective sheets. Accordingly, variation is caused in the positions of image forming on the respective plural sheets. Accordingly, in case of forming images as cut marks, the above described variation essentially creates gaps between the positions of the images, even if image forming is attempted to be performed on the same position on the respective sheets. In the case where cut marks are attached to the respective sheets with gaps between the positions thereof, if a cutting processing is performed with reference to the cut marks on the sheet on the top surface of the stack of the sheets, cut marks on the sheets other than the one on the top surface may remain after cutting, which degrades the image quality.

SUMMARY OF THE INVENTION

An object of the invention is to provide an image forming apparatus that can solve the problem which is caused in the case of cutting sheets after image forming with cut marks attached, wherein the problem is that cut marks remain on sheets after cutting the sheets due to gaps between the positions of the cut marks, with respect to the front side and back side of each sheet or a plural number of sheets.

In an aspect of the invention, an image forming apparatus includes an image forming section that forms an image on a sheet, based on image data of a job, a sheet ejection tray on which to stack sheets having been formed with an image, and a controller to control image forming, wherein the controller performs control to form an image based on a composite image of image data and a cut guide attached to the image data only on a first image forming page or a last image forming page.

BRIEF DESCRIPTION OF THE DRAWINGS

FIGS. 8A to 8B are schematic perspective views showing the relationship between shift-ejection sheets and the side to which cut marks are attached in a sort mode, in the embodiment;

PREFERRED EMBODIMENTS OF THE INVENTION

A preferred embodiment of an image forming apparatus according to the present invention will be described below, referring to the attached drawings. However, the present invention is not limited thereto.

Figure 1:
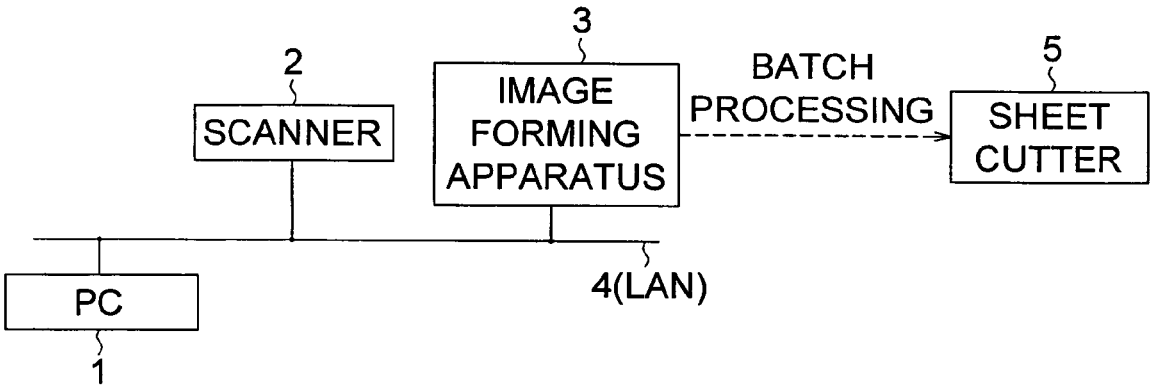
FIG. 1 is a block diagram that shows a system configuration including an image forming apparatus in accordance with an embodiment of the invention.

FIG. 1 is a block diagram showing the system configuration including an image forming apparatus according to a preferred embodiment of the present invention. This system includes a PC 1, a scanner 2, an image forming apparatus 3, a LAN 4, and a sheet cutter 5. Further, the image forming apparatus according to the present invention can be only an image forming apparatus 3 itself or can be image forming apparatus 3 to which the functions of a scanner 2 are added.

PC 1 is a personal computer. Image data and job data (hereinafter, referred to merely as job data) of setting conditions for image forming including the quantity of sheets for image forming and the order of image forming are input via PC 1. The scanner 2 is a reader of image data and inputs image data to the image forming apparatus 3 via LAN 4.

The image forming apparatus 3 employs an electro-photographic method and carries out image formation on a sheet, based on image data and job data inputted from PC 1 or from the scanner 2. Job data can also be input via an operation section (described later) of the image forming apparatus 3. The image forming apparatus 3 has a single sided mode for forming an image on a single side of a sheet and a double sided mode for forming an image on both sides of a sheet. The image. forming apparatus 3 also has sort modes for shift-ejecting of sheets P and an intersheet mode for inserting a front cover sheet and a back cover sheet.

The sheet cutter 5 carries out a cutting processing of sheets to cut a stack of sheets ejected from the image forming apparatus 3 into a predetermined size. Herein, the sheet cutter 5 reads the positions of cut marks (also referred to as register marks) on a sheet, and cuts the sheets based on this position information. For example, the sheet cutter cuts a sheet, based on cross-shaped cut marks printed on four corners of the sheet. Further, different types of sheet cutters use cut marks in different shapes. Further, sheets output from the image forming apparatus 3 are set to the sheet cutter 5 by an operator in a batch processing.

In the present embodiment, cut marks are employed as a cut guide to cut sheets. However, in accordance with the invention, any type of cut guide can be employed, not limited to cut marks. For example, the cut guide can be a set of four lines forming a rectangular shape or dots.

Image data and jobs are transmitted and received via LAN 4 between the PC 1, the scanner 2, and the image forming apparatus 3, using the CSMA/CD (Carrier Sense Multiple Access with Collision Detection) method or the like, with communication cables.

Figure 2:
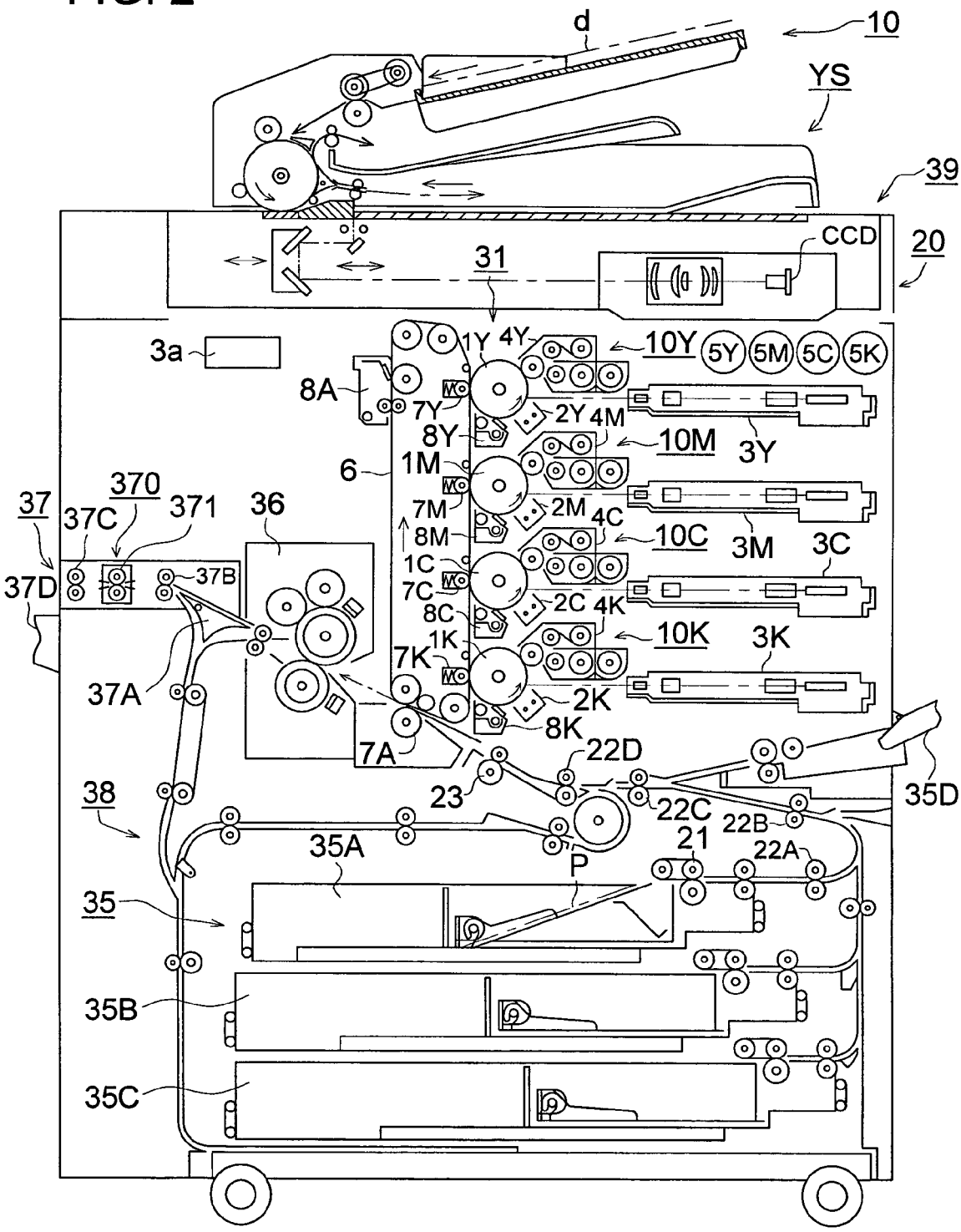
FIG. 2 is an entire configuration diagram of the image forming apparatus in accordance with the embodiment.

FIG. 2 is an entire configuration diagram of an electro-photographic type color image forming apparatus capable of image forming on both sides of sheets, which is an example of an image forming apparatus in accordance with the present embodiment of the invention.

In FIG. 2, the image forming apparatus 3 is called a tandem type color image forming apparatus, and has an automatic document feeder 10, a document reader 20 having a scanner function, an image forming section 31, an image processing section 32, image writing sections 3Y, 3M, 3C and 3K, a control unit 3*a*, a sheet feeding and conveying section 35, a sheet ejecting section 37, a sheet ejection tray 37D and a re-conveying unit (ADU) 38 for carrying out automatic double sided copying. The image forming section 31 includes plural sets of image forming sections 10Y, 10M, 10C and 10K, a belt-shaped intermediate transfer body 6, a sheet feeding and conveying section 35, and a fixing section 36.

The image forming section 10Y that forms images in yellow color includes a photoreceptor 1Y which is an image forming body, a charger 2Y, an exposure unit 3Y, a developing device 4Y, and a cleaning unit 8Y which are arranged around the photoreceptor 1Y. The image forming section 10M that forms images in magenta color includes a photoreceptor 1M which is an image forming body, a charger 2M, an exposure unit 3M, a developing unit 4M, and a cleaning unit 8M. The image forming section 10C that forms images in cyan color includes a photoreceptor 1C which is an image forming body, a charger 2C, an exposure unit 3C, a developing unit 4C, and a cleaning unit 8C. The image forming section 10K that forms images in black color includes a photoreceptor 1K which is an image forming body, a charger 2K, an exposure unit 3K, a developing unit 4K, and a cleaning unit 8K. The charger 2Y and the exposure unit 3Y, the charger 2M and the exposure unit 3M, the charger 2C and the exposure unit 3C, the charger 2K and the exposure unit 3K construct a latent image forming unit.

The intermediate transfer body 6 is an endless belt that is rotatably tension-supported by a plurality of rollers.

Units 5Y, 5M, 5C and 5K are toner supply units that supply fresh toner respectively to the developing devices 4Y, 4M, 4C and 4K.

The color image forming apparatus 3 has a single side mode for forming an image on a single side of a sheet and a double sided mode for forming an image on both sides of a sheet.

An image reader YS including an automatic document feeder 10 and a document reader 20 is provided on the top of the image forming apparatus 3. A document d placed on the top of the document table of the automatic document feeder 10 is conveyed by a conveying unit, an image on one side or images on both sides of the document are scan exposed by the optical system of the document reader 20 and are read by a line image sensor CCD.

The automatic document feeder 10 includes an automatic double sided document conveying unit. The document automatic feeder 10 reads the contents of documents d in a large quantity fed from the document table, continuously in a moment and can store the contents in a storage unit (electronic RDH function), thus conveniently used in a case of copying contents of a large number of documents by a copying function, in a case of transmitting a large number of documents d by a facsimile function, and in other cases.

Analog signals obtained by photoelectric conversion with the line image sensor CCD are subjected to analog processing, A/D conversion, shading correction, image compression, etc., in the image processing section, and the processed signals are transmitted to the image writing sections (the exposure units) 3Y, 3M, 3C and 3K. Optical signals are transmitted from the image writing sections 3Y, 3M, 3C, and 3K to the photoreceptors 1Y, 1M, 1C, and 1K of the image forming section 31 to form latent images, and are visualized as color images by the developing devices 4Y, 4C, and 4K.

Images in respective colors formed by the plural sets of image forming sections 10Y, 10M, 10C, and 10K of the image forming section 31 are sequentially transferred (primary transfer) to the rotating intermediate transfer body 6 by the transfer units 7Y, 7M, 7C, and 7K, and then a composite color image is formed. A sheet P stored in a sheet feeding cassette 35A is fed by a sheet feeding unit 21 and conveyed, through a sheet feeding rollers 22A, 22B, 22C, a registration roller 23, and the like, to a transfer unit 7A, and then the color image is transferred onto the sheet P (secondary transfer). The sheet P onto which the color images has been transferred is subjected to heat-and-pressure fixing processing with a fixing section 36, and sandwiched by a conveying roller 37B and an ejection roller 37C to be ejected and stacked onto a sheet ejection tray 37D outside the apparatus.

A sheet shift-ejecting section 370 being shifting means is disposed between the conveying roller 37B and the ejection roller 37C. However, normally, a sheet shift-ejecting roller 371 and a driven roller to have pressure contact with it are not in pressure contact with each other, and accordingly, the sheet P is not restricted by the sheet shift-ejecting section 370.

On the other hand, the intermediate transfer body 6 having transferred the color image to the sheet P with the transfer unit 7A and then separated from the sheet P gets rid of remaining toner by a cleaning unit 8A.

During the double sided mode, the sheet P having been finished with image forming on a first side and having passed the fixing section 36 is fed to the re-conveying unit 38 by a sheet-ejection-path switching plate 37A, and is again formed with an image on the second side in the image forming section 31. Thereafter, the sheet P is ejected and stacked onto the sheet-ejection tray 37D and by the conveying roller 37B and the sheet-ejection roller 37C of the sheet ejection section 37.

In the case of sheet reverse-ejection in the single sided mode, a sheet P having been finished with image forming and passed the fixing section 36 is fed to the re-conveying unit 38 by the sheet ejection-path switching plate 37A. Then, the front side and the back side of the sheet P are reversed by reverse rotation of a conveying roller (not given with a reference numeral) of the re-conveying unit 38 and ejected and stacked onto the sheet ejection tray 37D by the conveying rollers 37B and 37C.

When a sort mode is selected, the sheet shift-ejection roller 371 and the driven roller in the sheet shift-ejection section 370 are press-contacted with each other and slid in the direction orthogonal to the sheet conveying direction so as to shift a sheet P. The shifted sheet P is ejected onto the sheet ejection tray 37D by the sheet ejection roller 37C and stacked in a shifted state.

Figure 3:
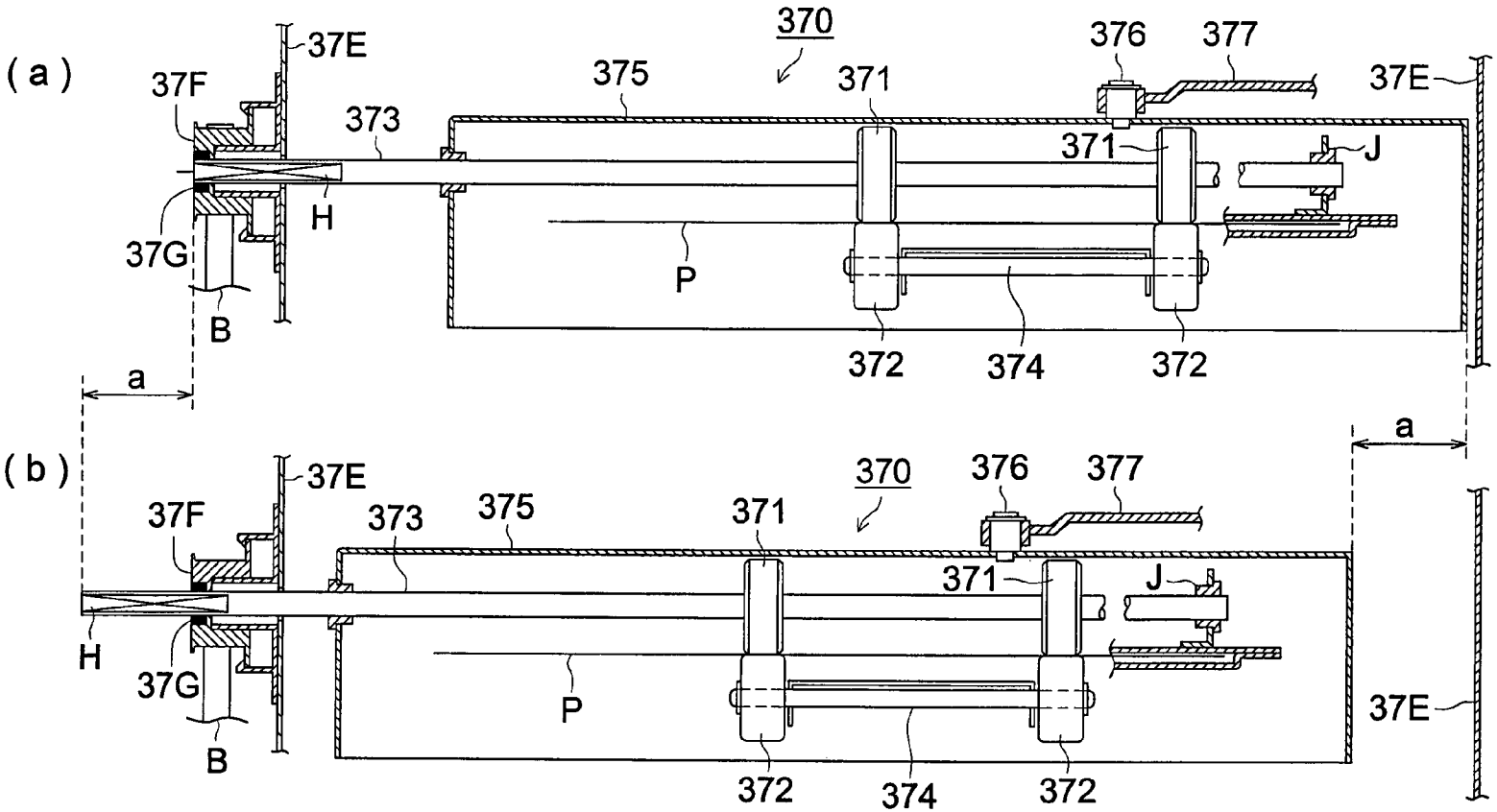
FIG. 3 is a side cross-sectional view for illustration of the configuration and operation of a sheet shift-ejection section 370 in accordance with the embodiment.

FIG. 3 is a side cross-sectional view for illustration of the configuration and operation of a sheet shift-ejection section 370 in accordance with the embodiment of the invention.

The sheet shift-ejection section 370 includes a rotation shaft 373 rotationally driven by a drive motor (not shown), a shift conveying roller 371 integrally fixed to the rotation shaft 373 to be rotationally driven, a driven roller 372 press-contacted with the spherical surface of the shift-conveying roller 371 to be rotationally driven, a frame 375 rotatably holding the shift-conveying roller 371 and the driven roller 372, a connecting pin 376, fixed to the frame 375, for transmitting a power to slide the entire sheet ejection section 370 in the direction orthogonal to the sheet conveying section, and an arm 377 having an engaging hole to engage with the connecting pin 376 so as to be slid in the direction orthogonal to the sheet conveying direction by a sheet shift-ejection drive motor and a link mechanism, not shown, thus sliding the connecting pin 376.

A driven motor, not shown, rotates a pulley 37F that is rotatably held by a body frame 37E of the image forming apparatus 3, through a belt B. The parallel-face section of an oil retaining bearing 37G which is pressure-fixed to the inner surface of the pulley 37F is engaged with a parallel-face section H which is formed at one end of the rotation shaft 373 of the driving roller 371, the parallel-face sections being slidable to each other. Thus, rotation of the pulley 37F rotates the rotation shaft 373. The other end of the rotation shaft 373 of the driving roller 371 is held by a bearing J which is integrally held with the frame 375.

The rotation shaft 374 of the driven roller 372 is rotatably supported by a floatingly movable support plate, not shown, and is normally separated from the shift-conveying roller 371 by the force of a spring. On the other hand, the conveying roller B also has a structure including a pressure-contact releasing section that allows switching between pressure-contact and pressure-contact releasing. Normally, the driving roller and the driven roller are pressure contacted by the force of a spring. Upon instruction from the control section 30, a solenoid, not shown, provided at the pressure-contact releasing section operates to release the pressure-contact.

If a sort mode is selected and image forming is instructed by the control section 30, a solenoid, not shown, is applied with a current to operate, synchronizing with the conveying timing of the sheet P. Herein, the force of the solenoid is larger than that of the spring, and accordingly, the driven roller 372 is pressure-contacted by the shift-conveying roller 371, with the sheet P sandwiched between them. Simultaneously, a solenoid provided at the pressure-contact releasing section of the conveying roller 37B operates to release the pressure-contact of the conveying roller 37B. Synchronizing with the timing when the driven roller 372 of the shift-conveying roller 371 sandwiches the sheet P, a driving motor that moves the sheet shift-ejection section operates to operate the connecting pin 376 through a link mechanism and the arm 377, thus the sheet shift-ejection section 370 being slid in the direction orthogonal to the sheet conveying direction.

When a job which selected the sort mode has been completed, the control section 30 stops applying the current to the solenoid that pressure-contacts the driven roller 372 driven by the shift-conveying roller 371, releases the pressure-contact, and operates the drive motor that moves the sheet shift-ejection section to move the sheet shift-ejection section 370 back to the original position through the link mechanism, the arm 377, and the connecting pin 376. Simultaneously, the control section 30 stops applying the current to the solenoid provided in the pressure-contact releasing section of the conveying roller 37B to make the conveying roller 37B into the pressure-contact state again.

In the present embodiment, a case where a sheet shift-ejection is performed by the sheet shift-ejection section 370 which slides in the direction orthogonal to the sheet conveying direction. However, sheet shift-ejection may also be performed such that the sheet ejection tray 37D slides in the direction orthogonal to the sheet conveying direction.

Figure 4:
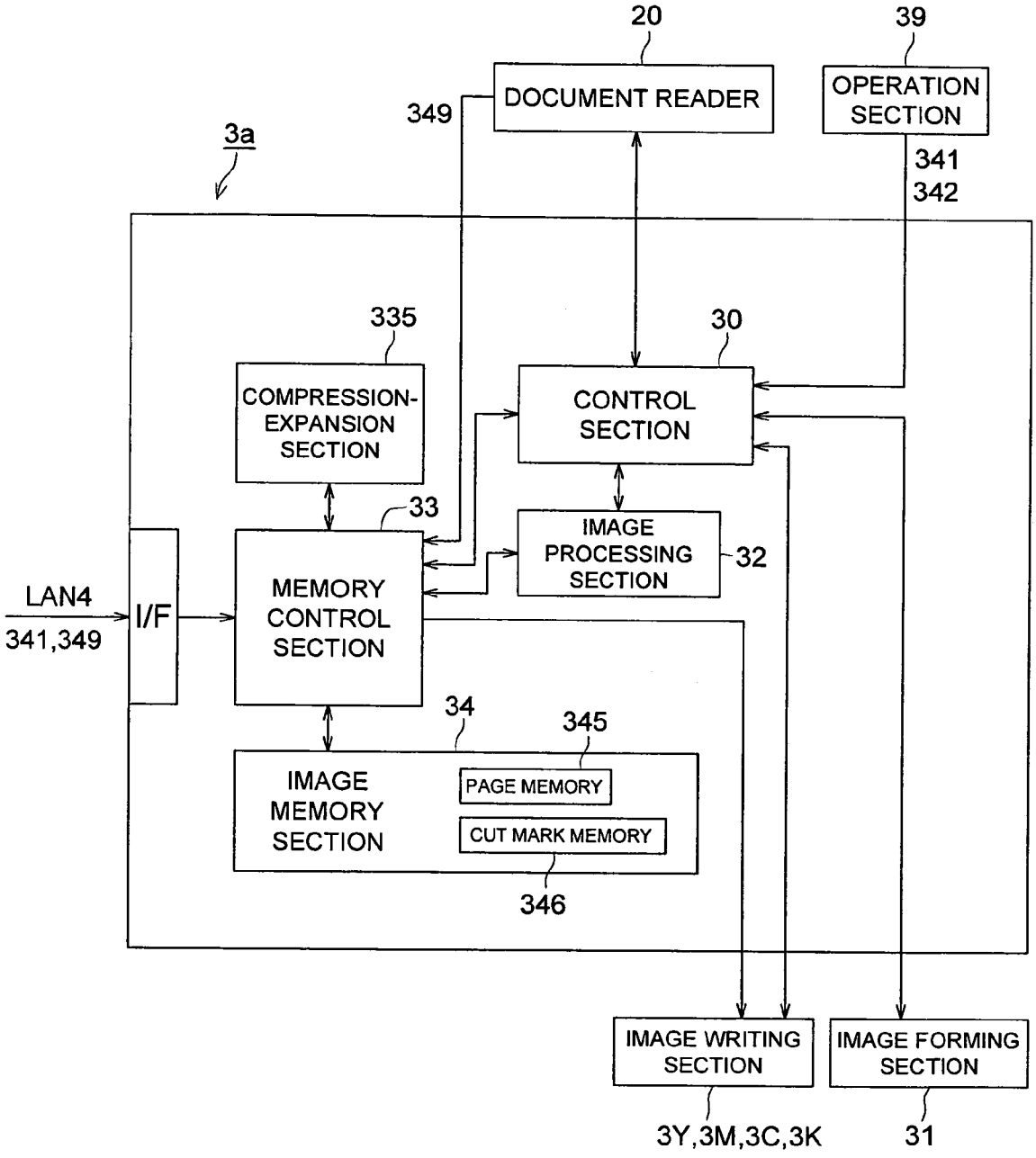
FIG. 4 is a block diagram related to a control system of the image forming apparatus 3 in accordance with the embodiment.

FIG. 4 is a block diagram related to a control system 3*a* of the image forming apparatus 3 in accordance with the present embodiment. The control system 3*a* of the image forming apparatus 3 includes the control section 30, the image processing section 32, a memory control section 33, a compression-expansion section 335, an image memory section 34, and an interface I/F.

The control section 30 contains a CPU and performs integral control of the image forming apparatus 3 and respective parts of it, including the document reader 20 and image writing section 3Y, 3M, 3C, and 3K, based on job data 341 inputted from LAN 4 or the operation section 39.

The memory control section 33 transmits the job data 341 or the image data 349 inputted via the interface I/F to the control section 30, the compression-expansion section 335, the image memory section 34, and the image processing section 32.

The image processing section 32 contains a computing processor. The image data 349 transmitted from PC1 or the scanner 2 is input to the image processing section 32 via the interface I/F and the memory control section 33 on the LAN 4. The image processing section 32 performs image processing, such as γ correction or bitmap conversion, when outputting the image data.

The image data 349 is electronic data generated by the image reader 20, PC 1, or the scanner 2 of the image forming apparatus 3. Cut mark information 342 is data for the shape and size of a cut mark, and is input via the operation section 39 and stored into a cut mark memory 346.

The image memory section 34 having a page memory 345 and the cut mark memory 346 stores the inputted image data 349 in the page memory 345 and the cut mark information 342 in the cut mark memory 346. The image memory section 34 also combines the image data 349 and the cut mark, according to the job data 341 from the control section 30 and stores the composite image in the page memory 346.

The cut mark memory 346 is a memory containing a program having been inputted in advance in order to determine the positions, the positions corresponding to the position of the image data 349, and the direction for attaching cut marks. The cut mark memory 346 stores the cut mark information 342 and provides the page memory 345 with data which is necessary for forming a composite image from the image data 349 and cut marks attached to the image data 349.

The operation section 39 includes display section, such as a LCD (Liquid Crystal Display), and an input unit, such as a touch panel or a ten key, to perform various setting for image forming. Further, input of the cut mark information 342, which will be later described, and selection of a surface or side to attach cut marks are also performed via the operation section 39.

The image forming section 31 feeds out a sheet P from a sheet feeding tray, according to job data 341 instructed from the control section 30, forms an image on the sheet P, and ejects and stacks the sheet P onto the sheet ejection tray 37D.

Next, the flow of the job data 341, the cut marc information 342, and the image data 349 in the control unit 3*a* will be described.

In the case where image data 349 is transmitted from the scanner 2 and the job data 341 is transmitted from PC 1, the job data 341 is transmitted to the control section 30 of the image forming apparatus 3 via the interface I/F and the memory control section 33 on LAN 4, and the image data 349 is transmitted to the memory control section 33 via the interface I/F.

In the case where the image data 349 and the job data 341 are transmitted from PC 1, the job data 341 is transmitted to the control section 30 of the image forming apparatus 3 via the interface I/F and the memory control section 33 on LAN 4, and the image data 349 is transmitted to the memory control section 33 via the interface I/F.

In the case where the job data 341 is generated by the operation section 39 of the image forming apparatus and the image data 349 is generated by the document reader 20 of the image forming apparatus, the job data 341 is directly transmitted to the control section 30 of the image forming apparatus 3, and the image data 349 generated by the document reader 20 is directly transmitted to the memory control section 33.

The cut mark information 342 is inputted from the operation section 39, transmitted to the image memory section 34 via the control section 30 and the memory control section 33, and then stored into the cut mark memory 346.

The control section 30 having received the job data 341 controls the memory control section 33, the image processing section 32, and the image forming section 31, according to the transmitted job data 341.

The memory control section 33 having received the image data 349 transmits the image data 349 to the image processing section 32, performs image processing, such as A/D conversion, γ correction, bitmap conversion, and the like, further transmits the image data 349 to the compression-expansion section 335 to expand and compress the image, and then temporarily stores the image data 349 into the memory section 34. Thereafter, upon instruction from the control section 30, the memory control section 33 transmits the image data 349 stored in the image memory section 34 to the compression-expansion section 335 to expand the image, then generates a composite image from the image data 349 and the attached cut marks by the use of the page memory 345 and the cut mark memory 346, and transmits the composite image to the image writing sections 3Y, 3M, 3C, and 3K. The image writing sections 3Y, 3M, 3C, and 3K performs writing onto the photoreceptor 1Y, 1M , 1C, and 1K of the image forming section 31, based on the transmitted composite image, and thus the processing moves into an image forming process with a plurality of image forming sections 10Y, 10M, 10C, and 10K.

Figure 5:
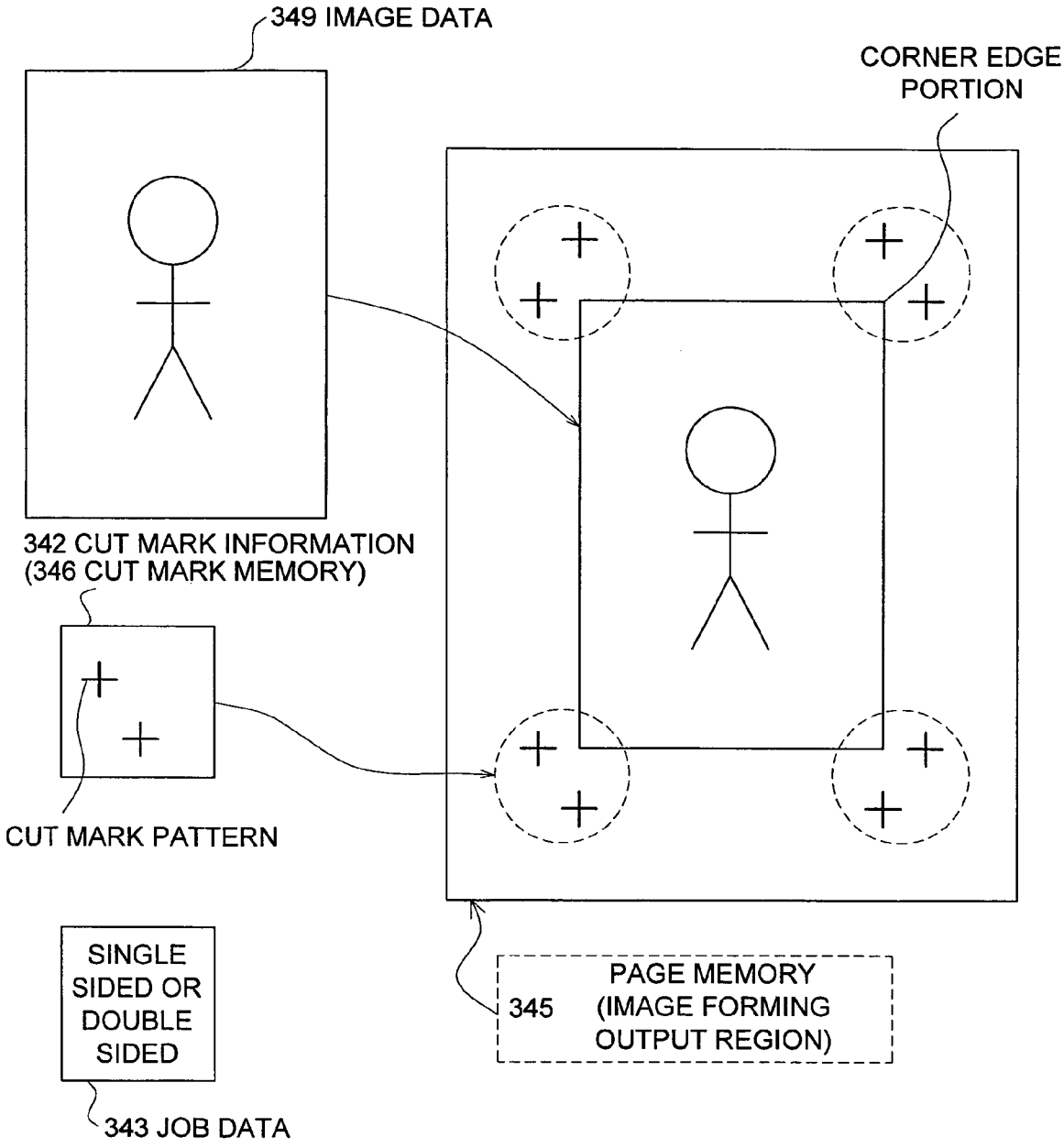
FIG. 5 is a diagram schematically showing attaching operation of cut marks with a cut mark memory 346.

FIG. 5 is a diagram schematically showing attaching operation of cut marks with a cut mark memory 346.

An operation from the operation section 39 calls a cut mark screen (later described) for attaching cut marks on the display section of the operation section 39, and then cut mark information 342 for the shape and size (also referred to as cut mark pattern) of a cut mark is selected. The cut mark information 342 is transmitted to the image memory section 34 and stored into the cut mark memory 346.

The page memory 345 is a memory to store the image data 349 for output to the image forming section 31, wherein the content of this memory will be output information at the time of image forming. Image forming is performed in the page memory 345 by combining the image data 349 and cut mark information 342 designated via the operation section 39. The image formed in the page memory 345 is written onto the photoreceptors 1Y, 1M, 1C, and 1K of the image forming section 31 through the memory control section 33 and the image writing section 3Y, 3M, 3C, and 3K. Further, in the case where the content of the page memory 345 is stored in the image memory 34, the content of the page memory 345 is properly image-compressed by the compression-expansion section 335, and further, subjected to image-expansion, as necessary, for image forming. Still further, a program for blank image data that has been inputted in advance is stored in the page memory 345 so that a blank page can be formed on a sheet P.

The image data 349 is disposed at a predetermined position in the vicinity, of the center of a page in the page memory 345, designating the output range of image forming. A cut mark is selected for the type of the mark by the operation section 39, based on the cut mark information 342, and is disposed with optimized direction and position in the vicinity of the four corner edges located on the image on the page memory 345, for a page that is determined to be attached with cut marks, according to the job data 341.

Figure 6:
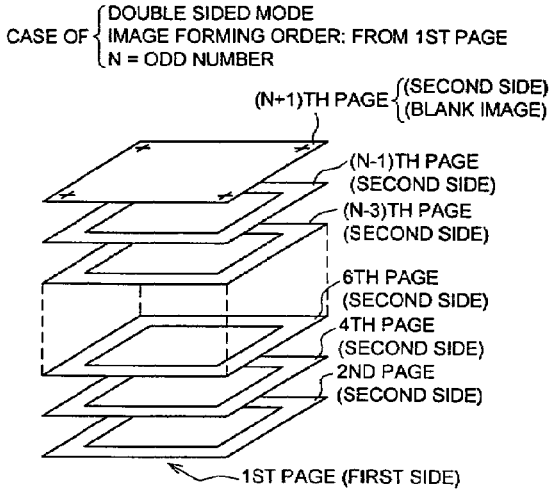
FIGS. 6A to 6D are schematic perspective views showing the relationship between the order of image forming and the side on which cut marks are put, in image forming on the both sides of sheets in the embodiment.
Figure 6:
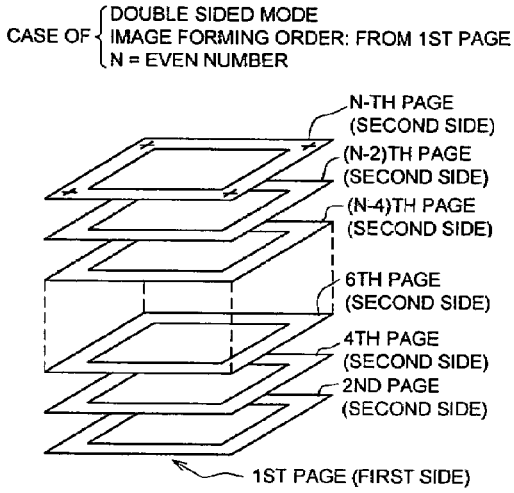
Figure 6:
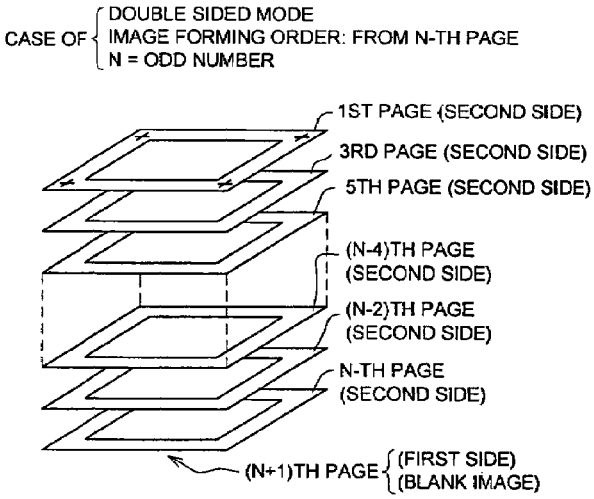
Figure 6:
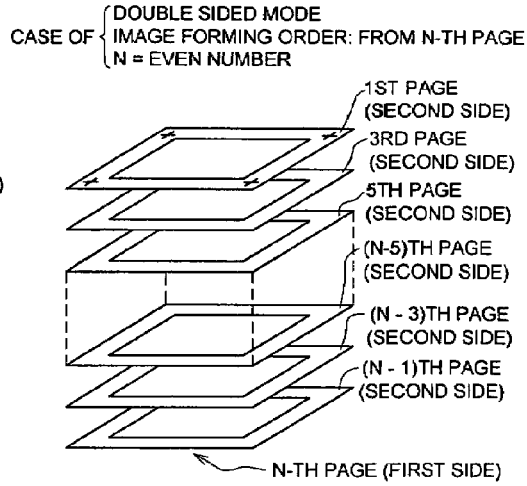

FIG. 6 is a schematic perspective view showing the relationship between the order of image forming and the side to which cut marks are attached, in image forming on sheets in the present embodiment of the invention. Symbol N denotes the total page quantity of sheets P in the job data 341 transmitted from PC 1 or the scanner 2 via LAN 4. Whether the order of stacking the sheets P during image forming on N pages is from 1st page to Nth page or from Nth page to 1st page is determined by the order of image forming (hereinafter, referred to as the image forming order) that is set from PC 1 or the scanner 2. The total page quantity N and the image forming order, which are a part of the job data 341, are inputted into the page memory 345 of the image forming apparatus 3 via LAN 4 and stored. In the specification, with respect to a sheet P, the side on which an image is firstly formed is referred to as the first side, and the side on which an image is secondly formed is referred to as the second side. FIG. 6 shows the state of stacking sheets P in the case that job data 341 inputted via PC 1 or the operation section 39 attaches cut marks only to the uppermost side (a single side).

The image forming order in FIG. 6 is controlled by an instruction from the control section 30 having received an input from the PC 1 or the scanner 2. As to whether to generate (N+1)th page (later described), which depends on if the total page quantity N is an odd number or an even number, and determination of the side to be attached with cut marks are controlled by an instruction which the control section 30 having received the job data 341 inputted from PC 1 or from the operation section 39 gives to respective sections of the image forming apparatus 3.

FIG. 6A is a diagram showing the relationship between the ejection state of sheets P and attachment of cut marks in a case where the total page quantity N is an odd number and image forming is sequentially performed starting with 1st page and ending with Nth page. In FIG. 6A, 1st page of the sheets P is firstly formed with an image (the first side), and then 2nd page is secondly formed with an image (the second side). Subsequently, image forming proceeds to 3rd page, page 4, . . . , and Nth page that is the last page of the image data. Nth page is the first side (lower side) because N is an odd number. Herein, Nth page is not attached with cut marks. If a sheet P which is ejected uppermost has not cut marks, it causes a problem in cutting the stack of the sheets with a sheet cutter. Therefore, in the invention, if N is an odd number, the control unit 3*a* forms (N+1)th page with blank image data and attaches cut marks to this (N+1)th page.

FIG. 6B is a diagram showing the relationship between the ejection state of sheets P and attachment of cut marks in a case where the total page quantity N is an even number and image forming is sequentially performed starting with 1st page and ending with Nth page. In FIG. 6B, 1st page of the sheets P is firstly formed with an image (the first side), and then 2nd page is formed with an image (the second side). Herein, because N is an even number, Nth page is ejected uppermost of the stack of the sheets on the sheet ejection tray, and cut marks are attached to Nth page. Accordingly, it is not necessary to form (N+1)th page with this combination of the total page quantity N and the image forming order.

FIG. 6C is a diagram showing the relationship between the ejection state of sheets P and attachment of cut marks in a case where the total page quantity N is an odd number and image forming is sequentially performed starting with Nth page and ending with 1st page. In FIG. 6C, Nth page of the sheets P is firstly formed with an image (the first side). The page firstly formed with an image is on the lower side as the first side in the image forming apparatus in the present embodiment. Therefore, if N is an odd number, pages with odd numbers are on the lower side. Accordingly, 1st page, which is lastly ejected, will be on the lower side, which will be a problem at the time of finishing the stack of the sheets. Therefore, in the present embodiment, if N is an odd number, (N+1)th page is formed as the image forming starting page (the first side) with blank image data, and the second side is formed as Nth page. Thus, 1st page, which is ejected last, becomes uppermost side, causing no problem at the time of finishing the stack of sheets. An image is formed on this 1st page, combining the image data 349 and cut marks.

FIG. 6D is a diagram showing the relationship between the ejection state of sheets P and attachment of cut marks in a case where the total page quantity N is an even number and image forming is sequentially performed starting with Nth page and ending with 1st page. In FIG. 6D, Nth page of the sheets P is firstly formed with an image (the first side), and then (N−1)th page is formed with an image. (the second side). Image forming is performed subsequently, and 1st page, which is uppermost ejected is the second side (uppermost surface), is the page attached with cut marks. Accordingly, it is not necessary to form page (N+1) with this combination of the total page quantity N and the image forming order.

Figure 7:
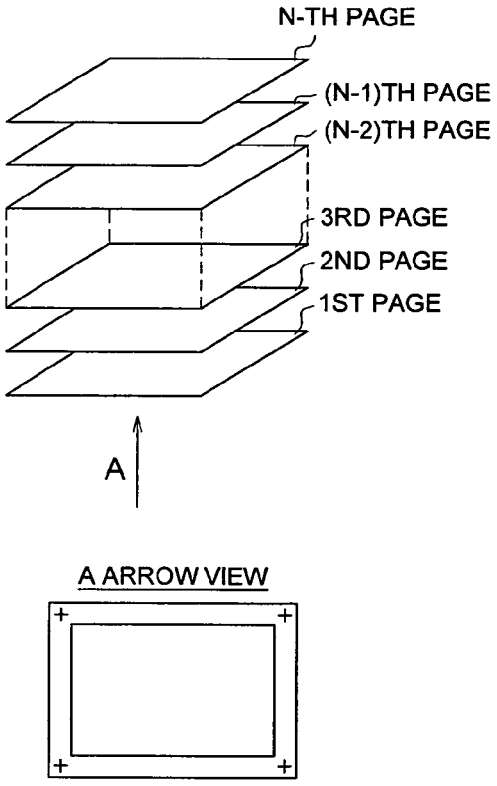
FIGS. 7A and 7B are schematic perspective views showing the relationship between the order of image forming and the side to which cut marks are attached, in image forming only on a single side of sheets in the embodiment.
Figure 7:
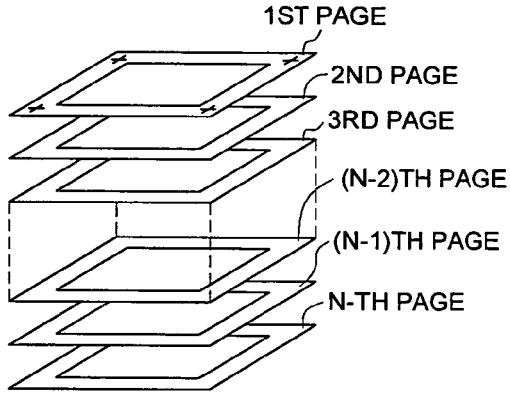

FIG. 7A and FIG. 7B are schematic perspective views showing the relationship between the order of image forming and the side on which cut marks are put, in image forming only on a single side of sheets in the embodiment. FIG. 7A is a diagram showing the relationship between the sheet ejection state of sheets P and attachment of cut marks in a case of image forming on N pages sequentially with the image order number starting with 1st page and ending with Nth page. FIG.

7B is a diagram showing the relationship between the sheet ejection state and attachment of cut marks in a case where image forming is sequentially performed with the image forming order starting with Nth page and ending with 1st page.

As shown in FIG. 7A, if the image forming order starts with 1st page, sheets P are reversely ejected by the re-conveying unit 38, and ejected onto the sheet ejection tray 37D with the image formed side facing downward and stacked. Herein, as shown by view direction arrow A, cut marks are attached only to 1st page.

As shown in FIG. 7B, if the image forming order starts with Nth page, sheets P are normally ejected onto the sheet ejection tray 37D with the image formed side facing upward and stacked. Herein, cut marks are attached only to 1st page.

FIGS. 8A and 8B are schematic perspective views for illustration of the state that cut marks are attached only to the last image forming page or the first image forming page of the stack of sheets which are shift-ejected in a double sided mode or a single sided mode in the present embodiment. FIG. 8A is a diagram showing the state where cut marks are attached only to the last image forming page of each stack of sheets which are shift-ejected. FIG. 8B is a diagram showing the state where cut marks are attached only to the first image forming page of each stack of sheets which are shift-ejected.

FIG. 8A shows the state of a case where sheets P are shift-ejected in the double sided mode, or the state of a case where the image forming order starts with Nth page of sheets P in N pages in the single sided mode and sheets P are shift-ejected. Cut marks are attached only to the last image forming page (uppermost face) of each stack of sheets which are shift-ejected.

FIG. 8B shows the state of a case where the image forming order starts with 1st page of sheets P in N pages and the sheets P are shift-ejected in the single sided mode. Cut marks are attached only to the first image forming page (lowermost face) of each stack of sheets which are shift-ejected. View on arrow A in FIG. 8B is a bottom view showing the first image forming page, wherein a composite image in which cut marks are attached to the image data 349 is formed on the first image forming page. Further, a composite image in which cut marks are attached to image data. 349 is formed on the first image forming page of each stack of sheets after shift-ejection as well as the first image forming page which is the lowermost face of the sheets in N pages.

The states shown in FIGS. 8A and 8B are also in a case where the stack of sheets in N pages is a plurality of groups in page unit of sheets (later-described) and in a case where the stack of sheets in N pages is a plurality of groups in volume unit of sheets (later described).

Figure 9:
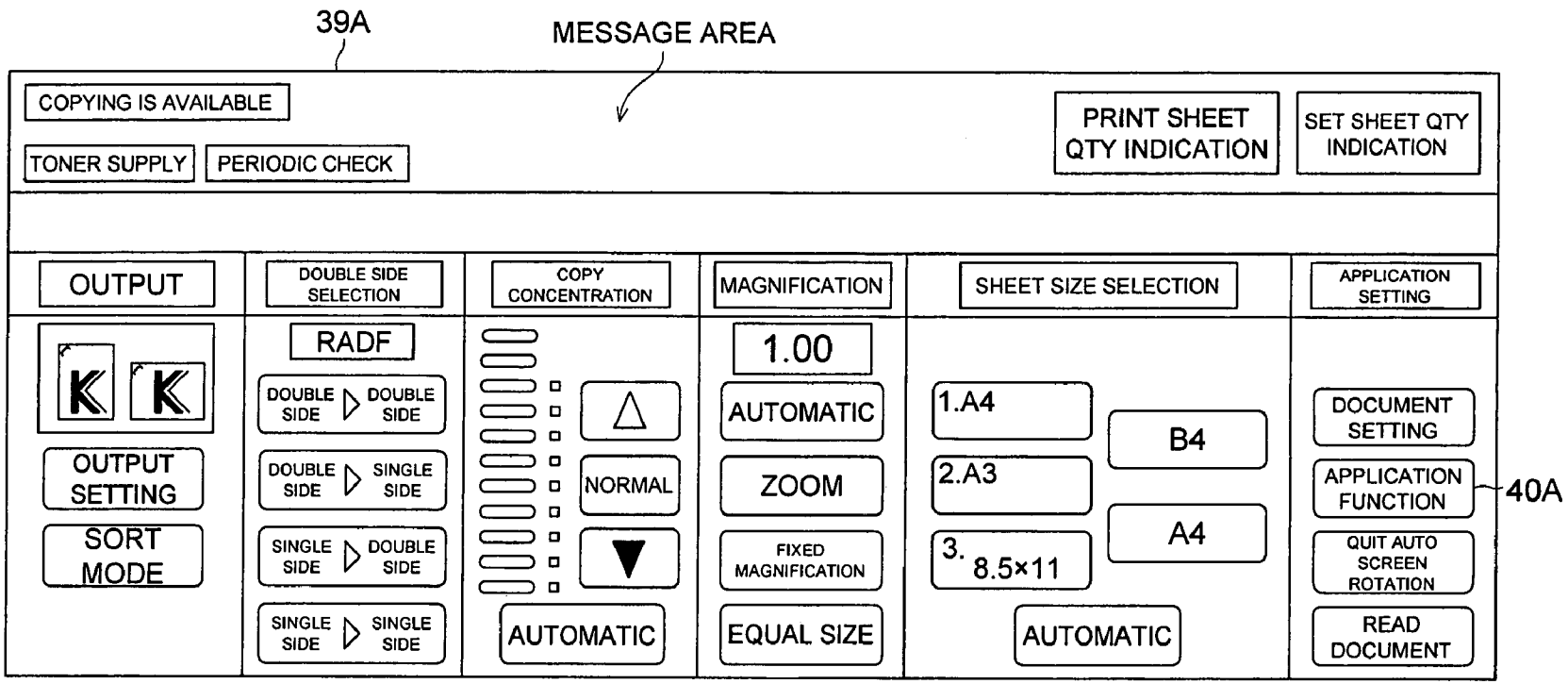
FIG. 9 is a display screen that is displayed on a display section of an operation section 39 in accordance with the embodiment.

FIG. 9 is a display screen 39A that is displayed on a display section of the operation section 39 in accordance with the present embodiment, and is a screen displayed on the display section after selecting a monochrome image forming mode from the category of a color image forming mode and the monochrome image forming mode on an initial screen, not shown, on the display section of the operation section 39.

The sheet quantity having been set for image forming sheets and the sheet quantity of image forming sheets having been formed with an image are displayed at the right top of the display screen 39A in FIG. 9. In the lower part, there are disposed output selection buttons to set an output state, double side selection buttons to select a double sided mode or a single sided mode, copy density selection buttons, magnification selection buttons, sheet size selection buttons, and other application function setting buttons to set other application functions. The application function setting buttons include an application function selection button 40A, and the output selection buttons include a sort mode selection button 41A.

Figure 10:
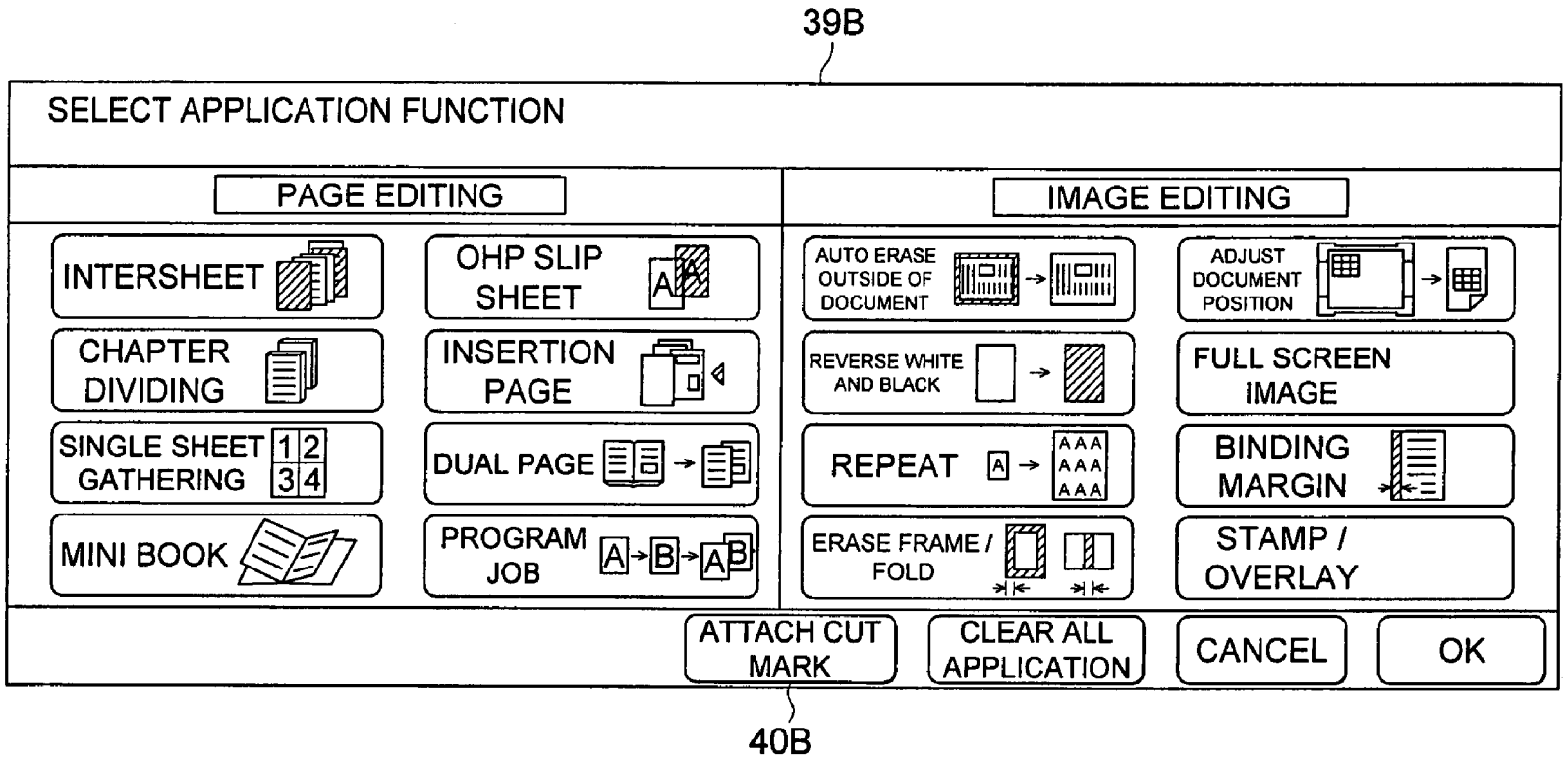
FIG. 10 is a screen next to the display screen in FIG. 9.

FIG. 10 is a screen next to the display screen in FIG. 9, and is a display screen 39B which is displayed when the application function selection button 40A shown in FIG. 9 is selected. The display screen 39B is divided into a page editing button group and an image editing button group. The page editing button group includes an intersheet selection button 40B. At the bottom, there are disposed an all applications clear button to clear application functions, OK button to confirm a selected button, a cancel button to cancel a selected button, and a cut mark attaching button 41B to set attaching of cut marks.

Figure 11:
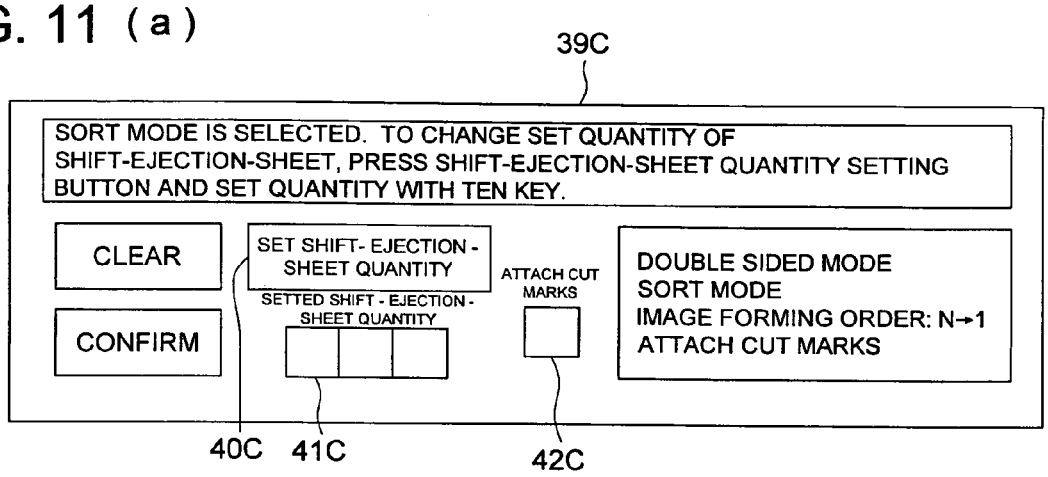
FIGS. 11A and 11B are screens next to the display screen in FIG. 9.
Figure 11:
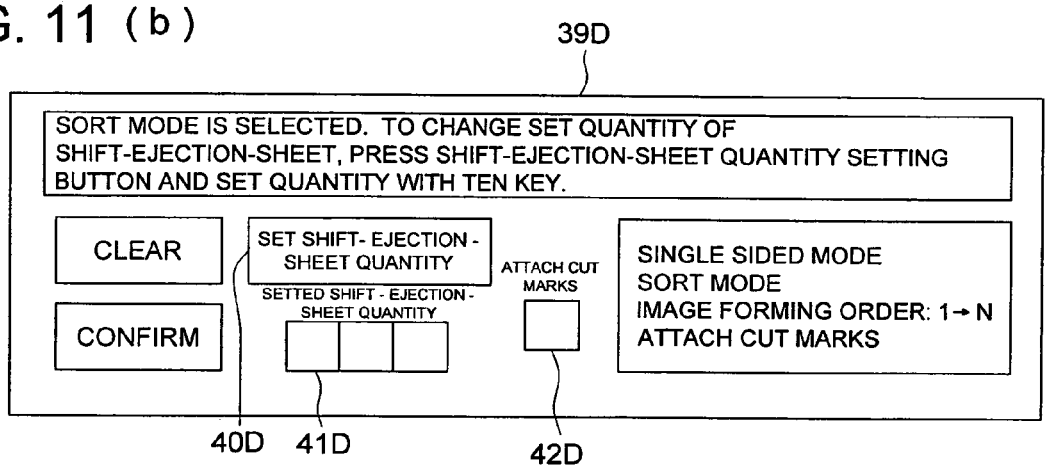

FIGS. 11A and 11B are screens next to the screen in FIG. 9 and are display screens 39C and 39D having functions of a cuttable sheet quantity input section in accordance with the invention. FIG. 11A shows the display screen 39C that is displayed when an operator selects a double sided mode and the sort mode selection button 41A on the display screen 39A shown in FIG. 9, and FIG. 11B shows the display screen 39D that is displayed when the operator selects a single sided mode and the sort mode selection button 41A on the screen 39A shown in FIG. 9. The shiftable quantity of stacked sheets can be changed, according to the maximum quantity of sheets within the cutting capacity of a cutting machine used in a later process, and the operator can re-set the shiftable quantity of stacked sheets to be ejected via the display screen 39C or 39D. The shiftable quantity of sheets is set in advance as the maximum shiftable quantity of sheets in the page memory 345 of the image memory section 34, and is a numerical data to be stored. At the top of the display screens 39C and 39D, a comment is displayed informing the state of the control section 30 or an advice for the user about operations. In the lower left part, displayed are a clear button for removing information on the display screen, a shift-ejection-sheet quantity setting button 40C or 40D to re-set the shift sheet quantity of an output stack, a set shift-ejection-sheet quantity indicator 41C or 41D to display the quantity having been set, and a confirmation button to confirm the settings on the screen. In the lower right part, displayed are a cut mark attaching buttons 42C and 42D to select whether or not to attach cut marks, an indicator as to whether a double sided mode or single sided mode is currently selected for image forming, an indicator as to whether the sort mode is selected, an indicator of the designated image forming order, and an indicator as to whether or not attaching cut marks is selected.

If the sheet quantity in a job exceeds the sheet quantity that has been set and is indicated by the set shift-ejection-sheet quantity indicator 41C or 41D, and the confirmation button is pressed without changing the set quantity indicated on the set shift-ejection-sheet quantity indicator 41C or 41D, then sheets are shift-ejected automatically in the sheet quantity indicated in the set shift-ejection sheet quantity indicator 41C or 41D.

In a case that the operator wants to change the shift-ejection-sheet quantity, if the operator presses the shift-ejection-sheet quantity setting button 40C or 40D and inputs a desired shift-ejection-sheet quantity by operating the ten key, not shown, of the operation section 39, then the desired shift-ejection-sheet quantity is indicated in the set shift-ejection-sheet quantity indicator 41C or 41D, and if the operator presses the confirmation button, then sheets are shift-ejected automatically in the newly set shift-ejection-sheet quantity.

Figure 12:
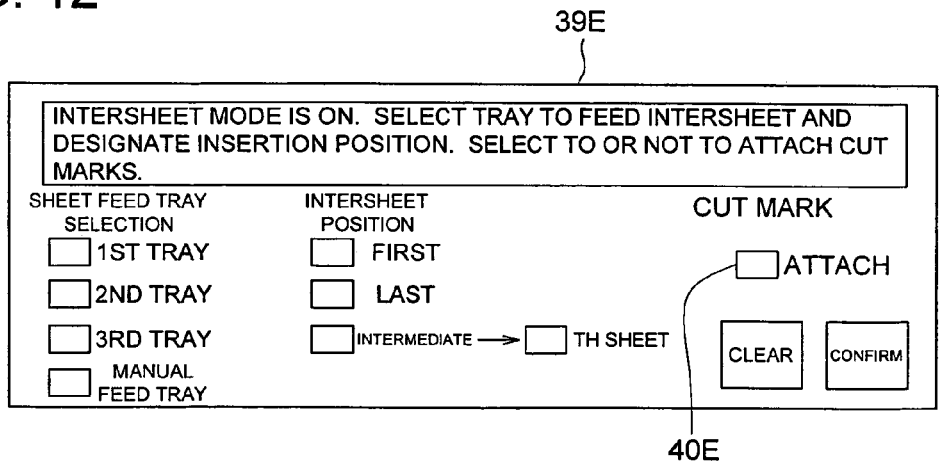
FIG. 12 is a screen next to the display screen in FIG. 10.

FIG. 12 is a screen next to the screen in FIG. 10 and is a display screen 39E that is displayed when the intersheet selection button 40B shown in FIG. 10 is selected. The display screen 39E allows input of selection of a sheet-feeding tray on which front cover sheets or back cover sheets to be conveyed as insertion sheets are loaded, input of the position of an insertion sheet with respect to the sheets P, and input as to whether or not to attach cut marks. At the top of the display screen 39E, a comment is displayed informing the state of the control section 30 or an advice for the user about operations. Selection buttons for a sheet-feeding tray are disposed in the lower left part; intersheets position buttons to set the position of the insertion sheet are disposed in the lower central part; and a cut mark attaching button 40E to select attaching cut marks, a clear button to clear information on the display screen, and a confirmation button to fix the settings on the screen are disposed in the lower right part. If an intermediate position is selected by the intersheet position button, then it is possible to input the position of insertion in a sheet quantity with the ten key, not shown, of the operation section 39.

Figure 13:
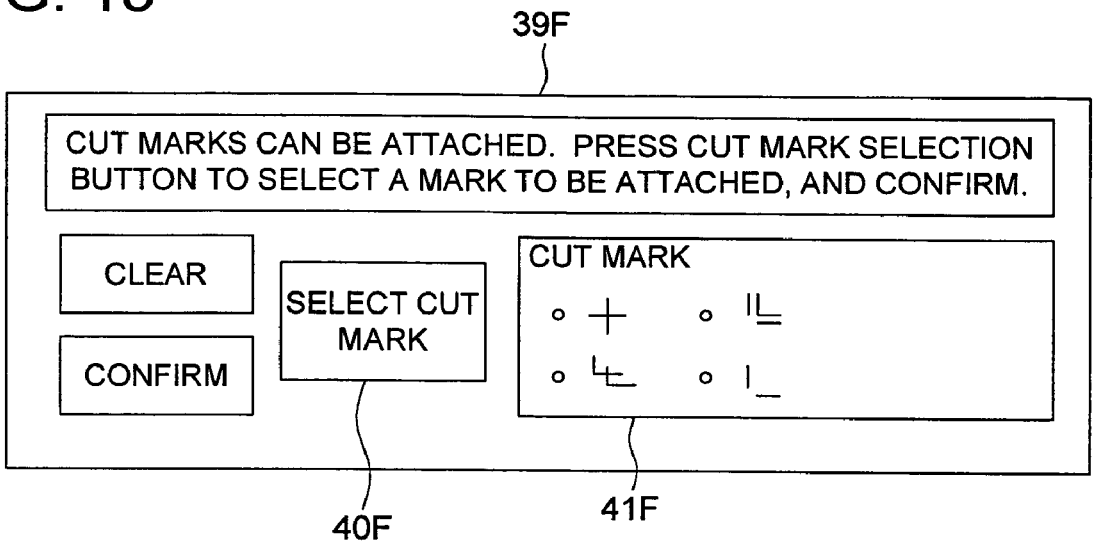
FIG. 13 is a screen next to the display screen in FIG. 10.

FIG. 13 is a screen next to the screen in FIG. 10 and is a display screen 39F for a cut mark attaching mode, which is displayed when the cut mark attaching button 41B, shown in FIG. 10, is selected. At the top of the display screen 39F, a comment is displayed informing the state of the control section 30 or an advice for the user about operations. In the lower left part, disposed are a clear button to remove information on the display screen, a cut mark selection button 40F to select the type of cut marks, and a confirmation button to fix the settings on the screen. In the lower right part, displayed is a cut mark display section 41F to display the type of cut marks. The type of a cut mark is selected by repeatedly pressing the cut mark selection button 40F to select a type when a marker corresponding to the type of cut mark is lighted.

Next, operations of the image forming apparatus 3, mainly related to the control section 30, will be described, referring to the diagrams showing the state of stacking sheets shown in FIGS. 6A to 8B, the diagrams showing display screens in FIGS. 9 to 13, and flowcharts in FIGS. 14 to 18.

Figure 14:
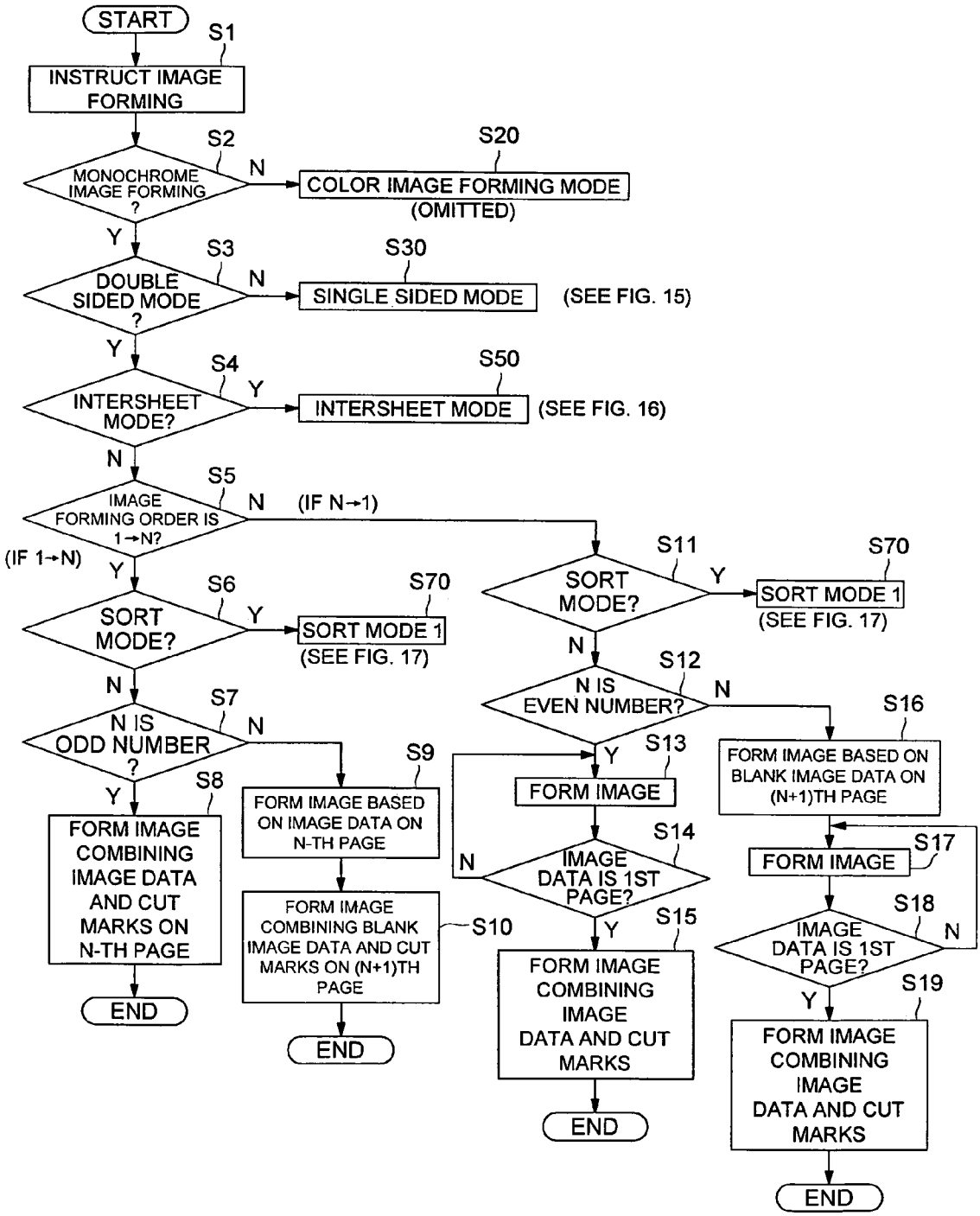
FIG. 14 is a flowchart showing the operation in the case where a cut mark attaching mode is selected in the image forming apparatus 3 in accordance with the embodiment.

FIG. 14 is a flowchart to describe the operation in the case where the cut mark attaching mode is selected in the image forming apparatus 3 in the present embodiment.

If an instruction to start image forming is output from PC 1 or the scanner 2 (step S1), then the control unit 3*a* transmits a signal of starting image forming to the control section 30 of the image forming apparatus 3 via LAN 4, and the control section 30 instructs the operation section 39 to display an initial screen, not shown, on the display section of the operation section 39.

The operator selects as to whether or not the desired mode is the monochrome image forming mode, on the initial screen on the operation section 39 (step S2). If the selected image forming mode is the monochrome image forming mode (step S2, Yes), then the control section 30 proceeds to step S3 and controls the display section of the operation section 39 to display the display screen 39A, shown in FIG. 9. If the selected image forming mode is not the monochrome image forming mode (step S2, No), then the control section proceeds to the color image forming mode in step S20. However, also in the color image forming mode, the structure and operation to attach cut marks, which is an object of the invention, are the same as in the monochrome image forming mode. Therefore, description of a process in the color image forming mode (step S20) will be omitted.

In step S3, the operator selects as to whether the desired mode is a double sided mode, via the display screen 39A (step S3). In step S3, if the selected mode is not a double sided mode (step S3, No), then the process proceeds to step S30 (a single sided mode), and the control section 30 issues an instruction to make the mode of the image forming apparatus to be a single sided mode (step S30, see FIG. 15). If the selected mode is a double sided mode (step S3, Yes), then the control section 30 proceeds to step S4 and the mode becomes the double sided mode from step S4, and then the operator selects as to whether or not to select the intersheet mode (step S4).

In step S4, if the intersheet mode is selected (step S4, Yes), then the process proceeds to the intersheet mode (step S50, see FIG. 16), and if the intersheet mode is not selected (step S4, No), then the process proceeds to step S5.

In step S5, the control section 30 determines whether or not the image forming order in job data 341 starts with 1st page and ends with Nth page (step S5). If the image forming order starts with 1st page (step S5, Yes), then the process proceeds to step S6, and if the image forming order starts with Nth page (step S5, No), then the process proceeds to step S11.

In step S6, the operator selects as to whether or not to select sort mode (step S6). If sort mode is selected (step S6, Yes), then the process proceeds to sort mode 1 (step S70, see FIG. 17), and if sort mode is not selected (step S6, No), then the process proceeds to step S7.

In step S7, the control section 30 determines whether or not the page quantity N in job data 341 is an even number (step S7), and if the page quantity N is an even number (step S7, Yes), then the control section 30 issues an instruction to the image forming section 31 to form an image on Nth page with blank image data attached with cut marks, as shown in FIG. 6B, and the image forming section 31 forms a composite image of blank image data and cut marks (step S8) on Nth page, and completes image forming.

Thus, in accordance with the invention, in a case where the image forming order starts with 1st page in a double sided mode, the last image forming page of sheets which are ejected and stacked becomes the upper side of the uppermost portion of the stack and is attached with cut marks. Therefore, it is not necessary to reverse the sheets upside-down in taking the ejected sheets out of an image forming apparatus and transporting the sheets to a sheet cutter, which prevents collapse of the stack of plural sheets.

In step S7, if the page quantity N is not an even number (step S7, No), then the process proceeds to step S9, and, as shown in FIG. 6A, after image forming on Nth page (step S9) based on image data, generates (N+1)th page as the final image forming page on the back side of Nth page, forming a composite image of blank image data and cut marks (step S10).

Thus, in accordance with the invention, even in a case where the quantity N of pages with image data is an odd number, the last page of ejected and stacked sheets becomes (N+1)th page to be the upper side of the uppermost portion of the stack, and blank image data and cut marks are attached to (N+1)th page. Therefore, it is not necessary to reverse the sheets upside-down in taking the ejected sheets out of an image forming apparatus and transporting the sheets to a sheet cutter, which prevents collapse of the stack of plural sheets.

In step S5, if the control section 30 determines that the image forming order start with Nth page (step S5, No), then the process proceeds to step S11, and the operator selects as to whether or not to select sort mode (step S11). If sort mode is selected (step S11, Yes), then the process proceeds to the sort mode 1 (step S70, see FIG. 17), and if sort mode is not selected (step S11, No), then the process proceeds to step S12.

In step S12, the control section 30 determines whether or not the page quantity N is an even number (step S12), and if it the page quantity N is an even number (step S12, Yes), then image forming stars with Nth page (step S13), as shown in FIG. 6D.

Next, the control section 30 confirms (step S14) at the time of image forming if image data 349 has reached 1st page after having started with Nth page, and if the image data 349 has not yet reached 1st page (step S14, No), then the process goes back to step S13 and continues image forming (step S13). When the image data 349 has reached 1st page (step S14, Yes), then the process proceeds to step S15.

In step S15, the control section 30 issues an instruction to the image forming section 31 to make 1st page to be the final image forming page and form a composite image of image data and cut marks, and the image forming section 31 forms a composite image of image data and cut marks on 1st page (step S15) to complete image forming.

IN step S12, the control section 30 determines whether the page quantity N is an even number (step S12), and if the page quantity N is not an even number (step S12, No), then as shown in FIG. 6C, the control section 30 performs control to form a blank image data (step S16) on (N+1)th page to be the image forming starting page on the back side of Nth page which is the starting page of image data. Then, image forming is performed on Nth page and after (step S17).

Next, the control section 30 confirms whether the image data 349 has reached 1st t page (step S18) at the time of image forming, and if the image data 349 has not yet reached 1st page (step S18, No), then the process goes back to step S17 to continue image forming (step S17). When the image data 349 has reached 1st page (step S18, Yes), then the process proceeds to step S19.

In step S19, the control section 30 issues an instruction to the image forming section 31 to make 1st page to be the final image forming page and form a composite image of the image data 349 and cut marks, and the image forming section 31 forms a composite image of image data and cut marks on 1st page (step S19), to complete image forming.

Thus, in accordance with invention, in a case where the image forming order starts with Nth page, 1st page that becomes the last image forming page is ejected and stacked as the upper side of the uppermost portion of the stack of sheets, and cut marks are attached to 1st page. Therefore, it is not necessary to reverse the sheets upside-down in taking the ejected sheets out of an image forming apparatus and transporting the sheets to a sheet cutter, which prevents collapse of the stack of plural sheets.

Figure 15:
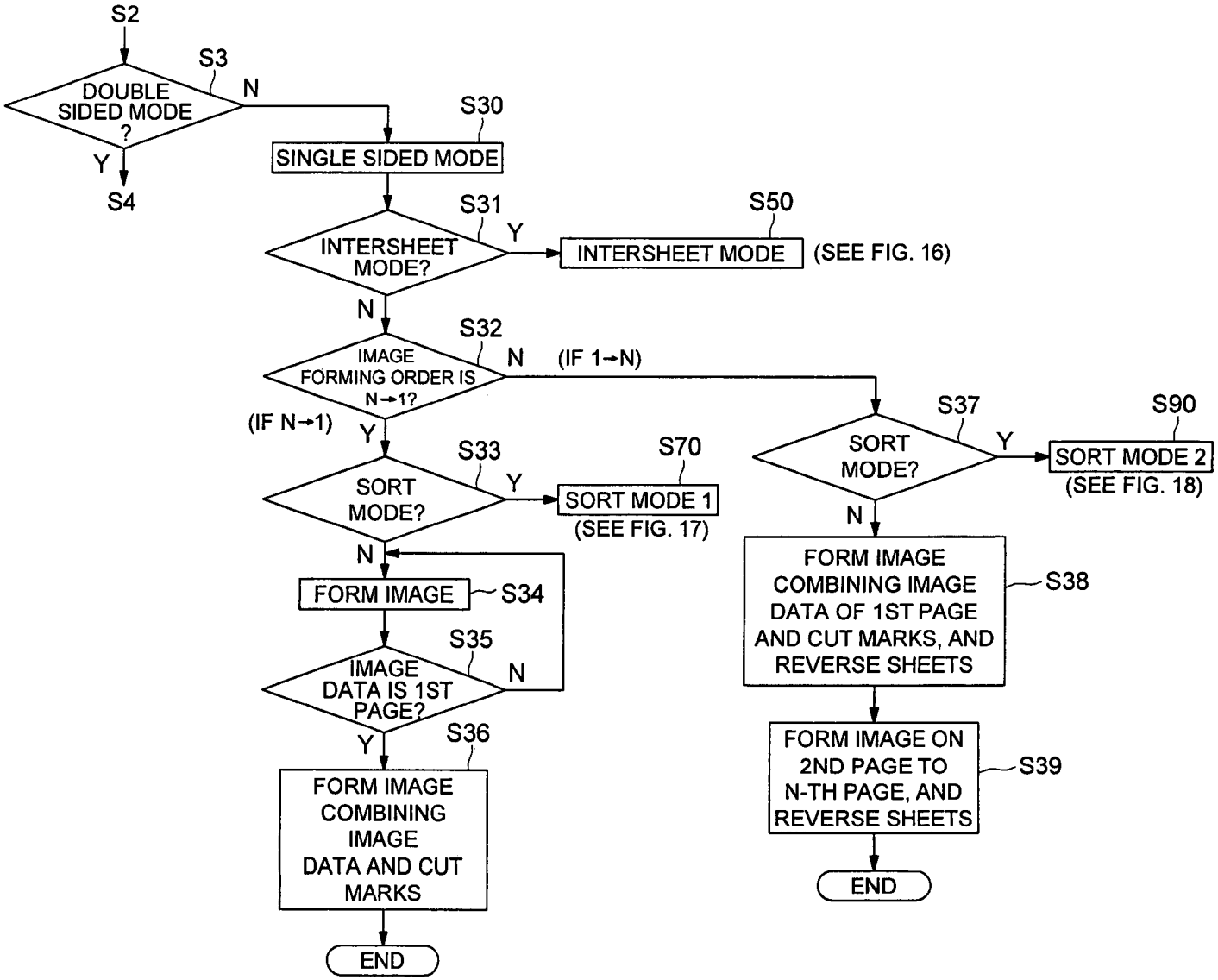
FIG. 15 is a flowchart showing the operation in a single side mode.

FIG. 15 is a flowchart describing the operation in a single sided mode which is selected when the mode desired by the operator is not a double sided mode in step S3 (step S3, No) in FIG. 14.

In step S30, if a single sided mode is selected by the operator via the display screen 39A, shown in FIG. 9, the process proceeds to step S31, and the display screen 39B, shown in FIG. 10, is displayed, and the operator selects whether or not to select the intersheet mode with the intersheet selection button 40B (step S31). If the intersheet mode is selected (step S31, Yes), the process proceeds to the intersheet mode (step S50, see FIG. 16), and if the intersheet mode is not selected (step S31, No), the process proceeds to step S32.

In step S32, the control section 30 determines whether or not the image forming order starts with Nth page and ends with 1st page (step S32). If the image forming order starts with Nth page (step S32, Yes), then the process proceeds to step S33, and if the image forming order starts with 1st page (step S32, No), then the process proceeds to step S37.

In step S33, the operator selects as to whether or not to select sort mode (step S33), and if sort mode is selected (step S33, Yes), the process proceeds to the sort mode 1 (step S70, see FIG. 17), and if sort mode is not selected (step S33, No), then the process proceeds to step S34.

In step S34, the control section 30 issues an instruction to the image forming section 31, as shown in FIG. 7B, to start image forming on the single side starting with Nth page (step S34).

Next, the control section 30 confirms whether or not the image data 349 has reached 1st page (step S35). If the image data 349 has not reached 1st page (step S35, No), the process goes back to step S34 to continue image forming (step S34). When the image data 349 has reached 1st page (step S35, Yes), then the process proceeds to step S36.

In step S36, the control section 30 issues an instruction to the image forming section 31 to make 1st page to be the final image forming page and form a composite image of image data and cut marks on 1st page, and the image forming section 31 forms a composite image of the image data and cut marks on 1st page (step S36) to complete image forming.

Thus, in accordance with the invention, in a case where image forming is performed only in a single sided mode and the image forming order starts with Nth page, it is possible to prevent that cut marks remain on other sheets after cutting a stack of sheets, by attaching cut marks only to 1st page, namely the last image forming page.

In step S32, if the image forming order starts with 1st page (step S32, No), then the control section 30 proceeds to step S37, and the operator determines whether or not to select sort mode (step S37). If sort mode is selected (step S37, Yes), then the process proceeds to the sort mode 2 (step S90, see FIG. 18), and if sort mode is not selected (step S37, No), then the process proceeds to step S38.

In step S38, the control section 30 issues an instruction to the image forming section 31, as shown in FIG. 7A, to start image forming on the single side with 1st page, attaching the cut marks to the image data 349 and forming a composite image of the image data 349 and the cut marks on 1st page, feeds the sheet P to the re-conveying unit 38, and ejects the sheet P onto the sheet ejection tray 37D, reversing the sheet upside-down, and stack the sheet (step S38). Then, the control section 30 performs control to form an image on the single side from 2nd page to Nth page, reversely eject the sheets onto the sheet ejection tray 37D, stack the sheets, and complete image forming (step S39).

Thus, in accordance with the invention, even in a case where image forming is performed only in a single sided mode and the image forming order starts with 1st page, it is possible to prevent that cut marks remain on other sheets after cutting a stack of sheets, by attaching cut marks only to 1st page, namely, the first image forming page.

Figure 16:
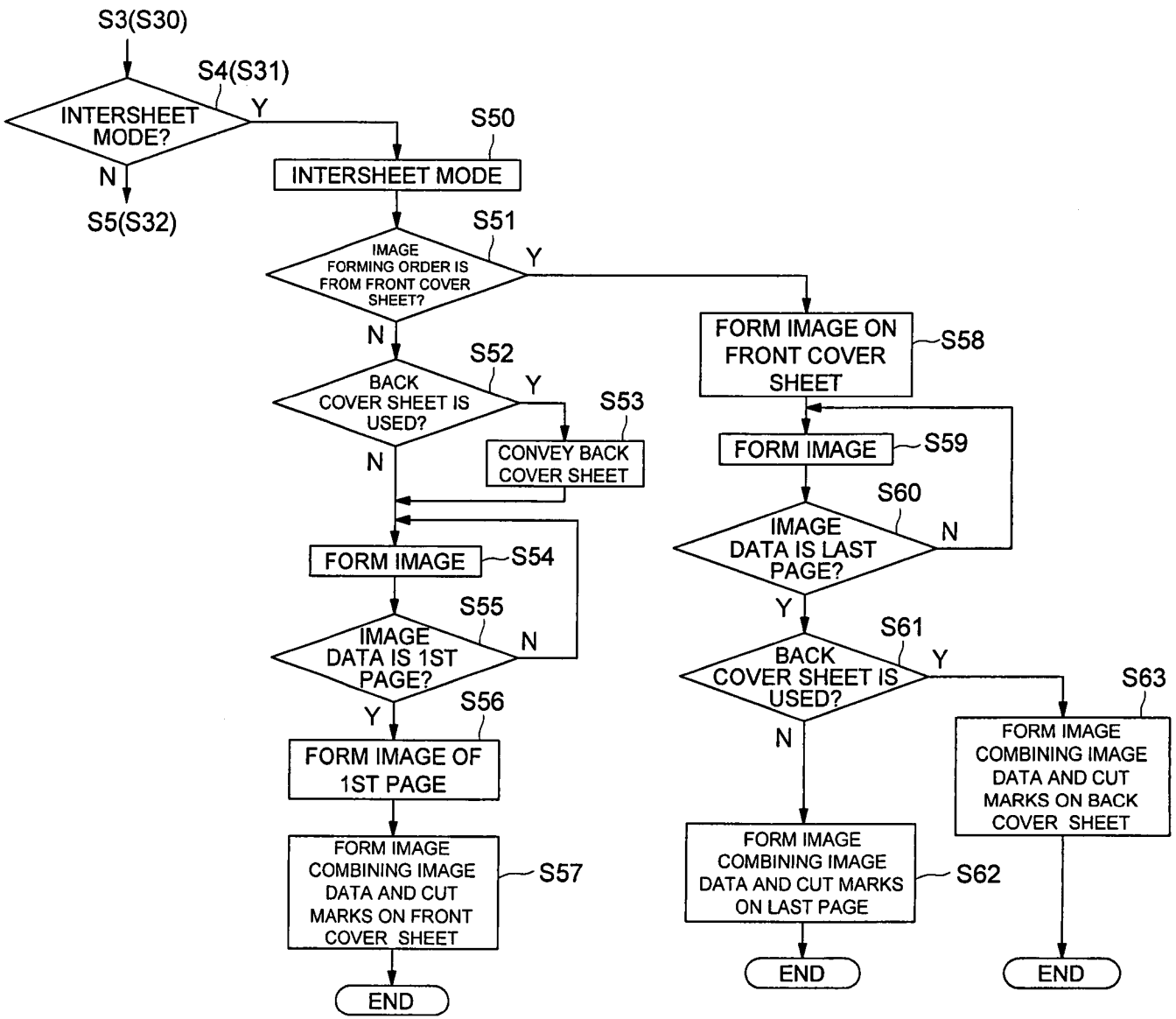
FIG. 16 is a flowchart showing the procedure of operation of inserting a front cover sheet or a back cover sheet, the sheet being attached with cut marks, to a stack of sheets in an inter-sheet mode.

FIG. 16 is a flowchart describing operations in the intersheet mode which is selected when the operator desires the intersheet mode in step S4 in FIG. 14 (step S4, Yes) or in step S31 in FIG. 15 (step S31, Yes).

The flowchart of the intersheet mode in accordance with the invention describes the procedure of operations to attach cut marks to a front cover sheet or a back cover sheet and insert the sheet in the stack of sheets.

The intersheet mode is a mode selected by the operator by pressing the intersheet button 40B on the display screen 39B, shown in FIG. 10, and the display screen 39E, shown in FIG. 12, is displayed on the operation section 39 (step S50).

The operator selects a sheet feeding tray, on which a desired cover sheet is mounted, from a plurality of sheet feeding trays by selecting a sheet feeding tray selection button on the display screen 39E. The operator also selects an intersheet position selection button (first, last) to determine the position to insert an insertion sheet, in other word, as to whether to insert the front cover sheet at the first of the image forming order (step S51). To attach cut marks, the operator presses the cut mark attaching selection button 40E and fixes it with the confirmation button.

If the cover sheet is to be inserted at the first of the image forming order (step S51, Yes), then the process proceeds to step S58, and if the cover sheet is to be inserted at the last of the image forming order (step S51, No), then the process proceeds to step S52.

Next, as to whether a back cover sheet is to be inserted (step S52) is selected with a sheet feeding tray selection button and an intersheet position selection button, and fixed with the confirmation button. If a back cover sheet is to be inserted (step S52, Yes), then the process proceeds to step S53, and if not to be inserted (step S52, No), then the process proceeds to step S54.

In step S53, the back cover sheet is fed out from the selected sheet feeding tray, and conveyed through sheet feeding rollers 22A, 22B, 22C, the registration roller 23, and the like to a transfer unit 7A. Then, an image is transferred onto the back cover sheet, based on image data, and the back cover sheet is conveyed through a fixing device 36, the conveying roller 37B, the sheet ejection roller 37C to the sheet ejection tray 37D (step S53).

Next, after performing image forming on the sheets P (step S54), starting with Nth page, the control section 30 confirms at the time of image forming if the image data 349 has reached 1st page after starting with Nth page (step S55). If the image data 349 has not reached yet 1st page (step S55, No), then the process goes back to step S54 and continues image forming (step S54), and if the image data 349 has reached 1st page (step S55, Yes), then the process proceeds to step S56. In step S56, image forming is performed on 1st page of the sheets P, based on the image data 349 (step S56).

Next, a front cover sheet is fed out from a sheet feeding tray that has been selected in advance, conveyed through the sheet feeding rollers 22A, 22B, 22C, the registration roller 23, and the like to a transfer unit 7A. Then, a composite image of image data and cut marks is transferred onto the cover sheet by the transfer unit 7A, and fixed by the fixing device 36. Then, the cover sheet is conveyed through the conveying roller 37B and the sheet ejection roller 37C to the sheet ejection tray 37D and stacked (step S57).

In step S51, if a front cover sheet is to be inserted at the first of the image forming order (step S51, Yes), the process proceeds to step S58, and the control section 30 issues an instruction to the image forming section 31 to feed out the front cover sheet from a selected sheet feeding tray, convey the cover sheet through the sheet feeding rollers 22A, 22B, 22C, registration roller 23, and the like to the transfer unit 7A, transfer an image based on the image data with the transfer unit 7A, fix the image with the fixing device 36, convey the cover sheet with the conveying roller 37B and the sheet ejection roller 37B, and stack the cover sheet onto the sheet ejection tray 37D (step S58).

Next, after performing image forming on the sheets P (step S59), starting with 1st page, the control section 30 confirms if the image data 349 has reached the last page, namely Nth page (step S60). If the image data 349 has not yet reached the last page (step S60, No), then the process goes back to step S59 and continues image forming (step S59), and if the image data 349 has reached the last page (step S60, Yes), then the process proceeds to step S61.

Next, as to whether a back cover sheet is to be inserted (step S61) is selected with a sheet feeding tray selection button and the intersheet position selection button, and fixed with the confirmation button. If a back cover sheet is to be added (step S61, Yes), then the process proceeds to step S63, and if not to be added (step S61, No), then the process proceeds to step S62.

If a back cover sheet is not to be added, an image is formed, combining image data and cut marks, on the last page of the sheets P, and image forming is completed (step S62).

If a back cover sheet is to be added, an image is formed, combining image data and cut marks, on the back cover sheet, and image forming is completed (step S63).

In the intersheet mode in a case where a front cover sheet or back cover sheet is ejected after ejection and stacking of sheets, the control section 30 instructs the image forming section 31 to attach cut marks only to the front cover sheet or the back cover sheet, and thus it is prevented that cut marks remain on the other sheets.

Next, operations in the case of attaching cut marks to a sheet P in sort mode will be described, referring to FIGS. 8A, 9, 11A, 17, and 18. In sort mode in the present embodiment, sheets P are shift-ejected in a unit of respective sheet stack by the use of the shift-sheet-ejection section 370. Herein, sort mode in the present embodiment include sort mode 1 which attaches cut marks only to the last image forming page of each sheet stack and sort mode 2 which attaches cut marks only to the first image forming page of each sheet stack.

Figure 17:
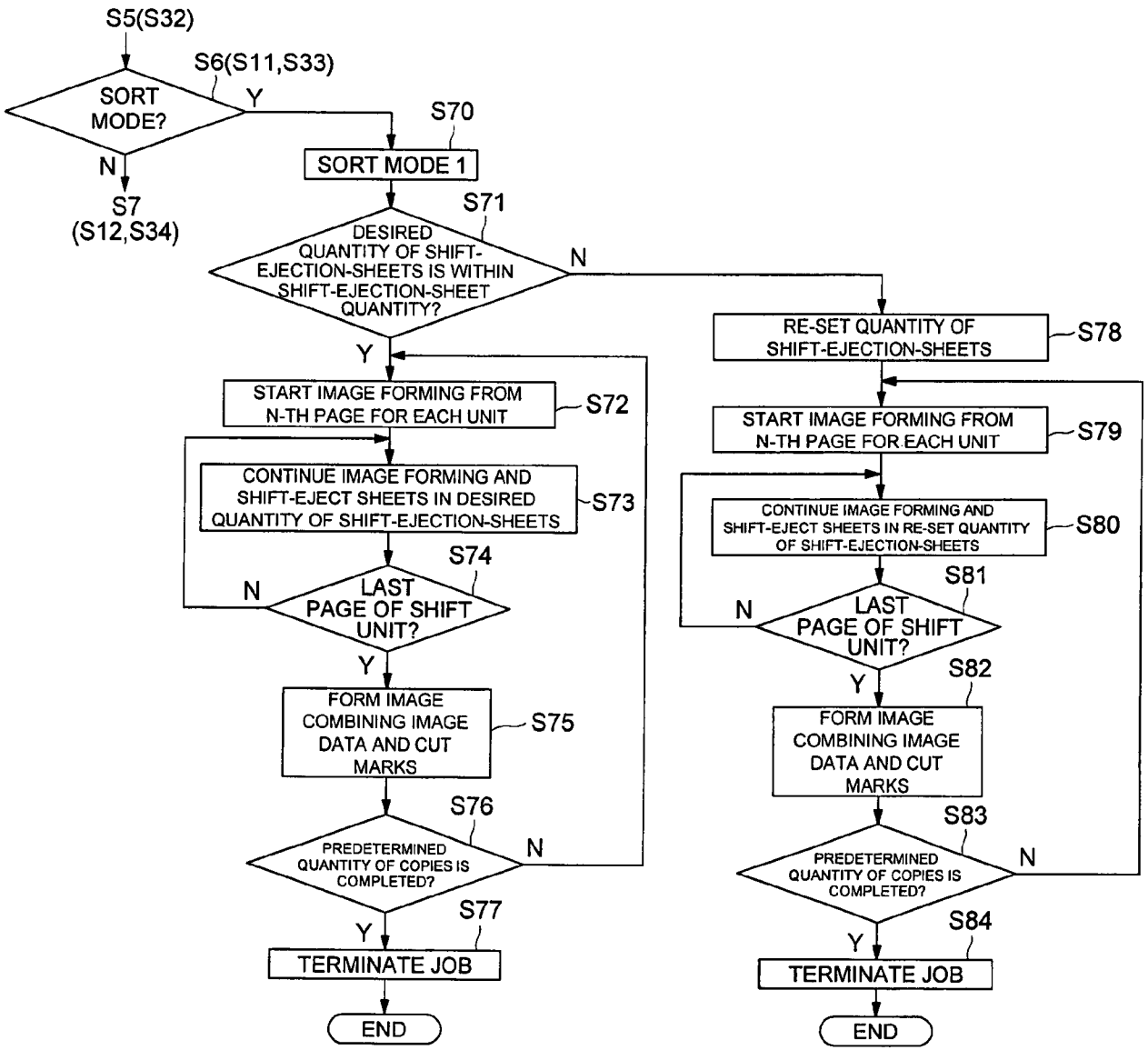
FIG. 17 is a flowchart showing the procedure of operation of attaching cut marks to sheets which are shift-ejected, in a sort mode.

FIG. 17 is a flowchart which describes operations to attach cut marks to a sheet P in the sort mode 1 which corresponds to a first embodiment of sort mode in accordance with the invention. The sort mode 1 is a mode that is selected when the operator desires a sort mode (step S6, S11, or S33, Yes) in the flowchart shown in FIG. 14 or 15. The flowchart shown in FIG. 17 is one that describes the procedure of operations to attach cut marks only to the last image forming page of each sheet stack of which sheets are shift-ejected as a unit.

The sort mode 1 is selected in such a manner that the operator selects a double sided mode on the display screen 39A, shown in FIG. 9, and further presses the sort mode selection button 41A. Then, the display screen 39C, shown in FIG. 11A, is displayed on the operation section 39 (step S70).

The operator confirms on the display screen 39C if the desired shift-ejection-sheet quantity is not larger than the quantity indicated by the set shift-ejection-sheet quantity indicator 41C (step S71). If the quantity is not larger than the indicated quantity (step S71, Yes), then the operator presses the confirmation button, and the process proceeds to step S72. If the quantity is larger than the indicated quantity (step S71, No), then the step proceeds to step S78.

In step S72, the control section 30 starts image forming from Nth page (starting page) of each shift unit, continues image forming on following pages, and performs shift-sheet-ejection, shown in FIG. 8A, in the desired shift-sheet-ejection quantity (step S73). Next, the control section 30 confirms if a sheet P to be formed with an image and shift-ejected reaches 1st page (the last page) of the respective shifted unit (step S74). If it reaches the last page (step S74, Yes), then the process proceeds to step S75, and if it does not reach the last page (step S74, No), then the process goes back to step S73.

If a sheet P to be formed with an image and shift-ejected reaches the last page, a composite image of image data and cut marks is formed on the last page (1st page), as shown in FIG. 8A (step S75).

Next, the control section 30 confirms if the job according to the job data 341 has completed image forming of a predetermined number of copies (step S76). If the job has completed it (step S76, Yes), the control section 30 terminates the job (step S77). If the job has not completed it (step S76, No), the process goes back to step S72.

In step S71, if the desired shift-ejection sheet quantity exceeds the quantity indicated on the set shift-ejection sheet quantity indicator 41C (step S71, No), then the process proceeds to step.S78, and the control section 30 re-sets the shift-ejection sheet quantity, according to the set sheet quantity that is indicated on the set shift-ejection sheet quantity indicator 41C on the display screen 39C, shown in FIG. 11A, and issues an instruction to the image forming section 31 to perform shift-ejection of sheets P (step S78).

In step S78, also, the operator can manually set the set shift-ejection-sheet quantity with the shift-ejection-sheet quantity setting button 40C. That is, by pressing the shift-ejection-sheet quantity setting button 40C and using the ten key, not shown, of the operation section 39, it is possible to re-set the shift-ejection-sheet quantity to a desired quantity.

The control section 30 starts image forming with Nth page (first page) of each shift unit (step S79), then continues image forming on following sheets, and performs shift ejection in the re-set shift-ejection-sheet quantity (step S80).

Next, the control section 30 confirms if a sheet P which is to be formed with an image and shift-ejected reaches 1st page (the last page) of the respective shift unit (step S81). If it reaches the last page (step S81, Yes), then the process proceeds to step S82, and if it does not reach the last page (step S81, No), then the process goes back to step S80.

If the sheet P to be formed with an image and shift-ejected reaches the last page, a composite image of image data and cut marks is formed on the last page (1st page) in step S82.

Next, the control section 30 confirms if the job based on the job data 341 has completed image forming for a predetermined quantity of copies (step S83). If the job has completed it (step S83, Yes), the control section 30 terminates the job (step S84). If the job has not completed it (step S83, No), the process goes back to step S79.

Next, operations in the case of attaching cut marks to sheets P in a sort mode 2 of a second embodiment of sort mode in accordance with the invention will be described, referring to FIGS. 8B, 9, 11B, and 18.

Figure 18:
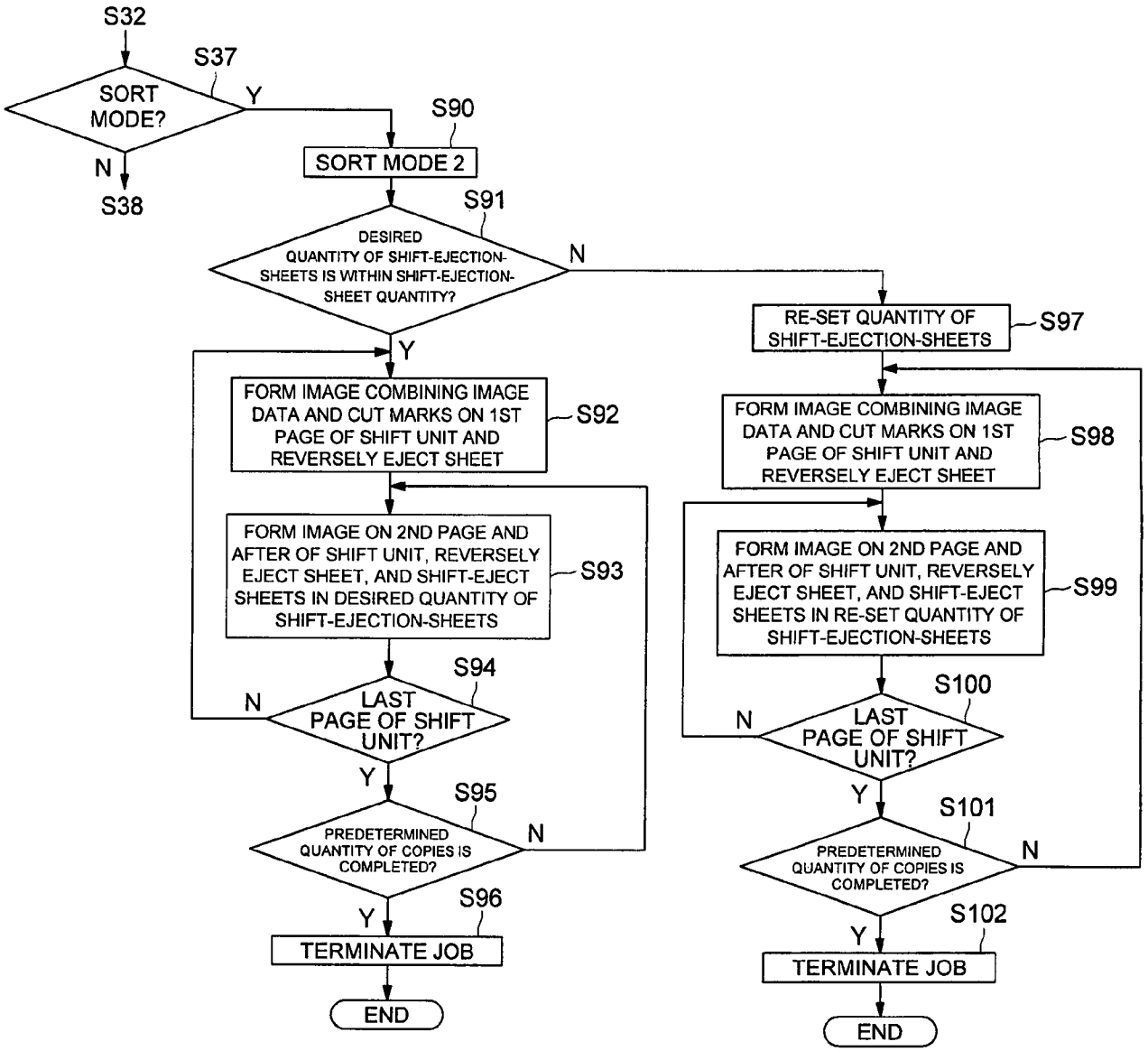
FIG. 18 is a flowchart showing the procedure of operation of attaching cut marks to sheets which are shift-ejected in another sort mode.

FIG. 18 is a flowchart that describes operations to attach cut marks to a sheet P in the sort mode 2. The sort mode 2 is a mode that is selected in the flowchart of the case of single sided mode, shown in FIG. 15, when the operator desires a sort mode (step S37, Yes). The flowchart shown in FIG. 18 is one that describes the procedure of operations to attach cut marks only to the first image forming page (1st page) of each sheet stack of which sheets are shift-ejected as a unit.

The sort mode 2 is selected in such a manner that the operator selects a single sided mode on the display screen 39A, shown in FIG. 9, and further presses the sort mode selection button 41A. Then, the display screen 39D, shown in FIG. 11B, is displayed on the operation section 39 (step S90).

The operator confirms on the display screen 39D if the desired shift-ejection-sheet quantity is not larger than the quantity indicated by the set shift-ejection-sheet quantity indicator 41D (step S91). If the quantity is not larger than the indicated quantity (step S91, Yes), then the operator presses the confirmation button, and the process proceeds to step S92. If the quantity is larger than the indicated quantity (step S91, No), then the step proceeds to step S97.

In step S92, the control section 30 starts image forming on sheets P with 1st page (the first image forming page) of each shift unit, forms a composite image of image data and cut marks on 1st page, as shown in FIG. 8B, and stacks the sheet onto the sheet ejection tray 37D, reversing the sheet by the re-conveying unit 38 (step S92). Subsequently, the control section 30 continues image forming on 2nd page and after, and performs shift-sheet-ejection, as shown in FIG. 8B, in a desired shift-ejection-sheet quantity (step S93). Next, the control section 30 confirms if a sheet P to be formed with an image and shift-ejected reaches the last page (Nth page) of the respective shifted unit (step S94). If it reaches the last page (step S94, Yes), then the process proceeds to step S95, and if it does not reach the last page (step S94, No), then the process goes back to step S93.

If a sheet P to be formed with an image and shift-ejected reaches the last page, the control section 30 confirms if the job based on the job data 341 has completed image forming for a predetermined quantity of copies (step S95). If the job has completed it (step S95, Yes), the control section 30 terminates the job (step S96). If the job has not completed it yet (step S95, No), the process goes back to step S92.

In step S91, if the desired shift-ejection sheet quantity exceeds the quantity indicated by the set shift-ejection sheet quantity indicator 41D (step S91, No), then the process proceeds to step S97, and the control section 30 re-sets the shift-ejection sheet quantity, according to the set sheet quantity that is indicated by the set shift-ejection sheet quantity indicator 41D on the display screen 39D, shown in FIG. 11B, and issues an instruction to the image forming section 31 to perform shift-ejection of sheets P (step S97).

In step S97, also, the operator can manually set the set shift-ejection-sheet quantity with the shift-ejection-sheet quantity setting button 40D. That is, by pressing the shift-ejection-sheet quantity setting button 40D and using the ten key, not shown, of the operation section 39, it is possible to re-set the shift-ejection-sheet quantity to a desired quantity.

The control section 30 controls the image forming section 31 to form a composite image of the image data 349 and cut marks on 1st page (the first image forming page) for each shift unit, and controls the re-conveying unit 38 to reversely eject the sheet P onto the sheet ejection tray and stack it (step S98).

Subsequently, the control section 30 controls the image forming section 31 to continue image forming on sheets P of 2nd page and after and perform shift-ejection of sheets (in step S99). Herein, the sheets includes 1st page (the lower side), for each shift unit, on which a composite image of the image data 349 and cut marks is formed. Next, the control section 30 confirms if a sheet P which is to be formed with an image and shift-ejected reaches the last page (Nth page) of the respective shift unit (step S100). If the sheet P reaches the last page (step S100, Yes), then the process proceeds to step S101, and if it does not reach the last page (step S100, No), then the process goes back to step S99.

If a sheet P to be formed with an image and shift-ejected reaches the last page, the control section 30 confirms if the job based on the job data 341 has completed image forming for a predetermined quantity of copies (step S101). If the job has completed it (step S101, Yes), the control section 30 terminates the job (step S102). If the job has not completed it yet (step S101, No), the process goes back to step S98.

Thus, in accordance with the invention, even in a case where the quantity of image forming sheets exceeds the cuttable quantity of sheets, by inputting the cuttable quantity of sheets with a sheet cutter to be used in a later process, shifting sheets in a quantity within the cuttable quantity of sheets when stacking sheets onto a sheet ejection tray, and attaching cut marks only to the last image forming page of each stack of sheets, each stack of sheets becomes a unit within the cuttable quantity of sheets and cut marks are attached to the face which will be the uppermost face when setting the stack of sheets to the sheet cutter, similarly to the case of attaching cut marks only to the last image forming page of image forming sheets within a cuttable quantity of sheets. Accordingly, the task with a sheet cutter will be easier.

Thus, in accordance with the invention, in a case where a job includes plural groups in volume unit, even if the quantity of image forming sheets in volume unit exceeds the cuttable quantity of sheets with a sheet cutter, the sheets are shifted within the cuttable quantity of sheets, which makes the task with the sheet cutter easier.

Thus, in accordance with the invention, in a case where a job includes plural groups in page unit, even if the quantity of image forming sheets in page unit exceeds the cuttable quantity of sheets, the sheets are sifted within the cuttable quantity of sheets, which makes the task with the sheet cutter easier.

In accordance with the invention, by attaching a cut guide, such as cut marks, only to the first image forming page or the last image forming page with respect to image data of a job, it is possible to prevent that a cut guide remains on a sheet other than the first image forming page or the last image forming page after cutting the stack of sheets.

Further, even in a case where image forming is performed by an electro-photographic method and images are fixed in a heat-fixing process, it is possible to obtain images in a high image quality free from a cut guide which could otherwise remain on sheets after image forming.

What is claimed is:

1. An image forming apparatus, comprising:

an image forming section that forms an image on a sheet, based on image data of a job;

a sheet ejection tray on which to stack sheets having been formed with an image;

a shifting unit that shifts and stacks the sheets onto the sheet ejection tray;

an operation section to set an image forming condition of the job;

a control unit to control image forming;

a sort mode to operate the shifting unit;

a double sided mode to form an image on both sides of a sheet; and a single sided mode to form an image on a single side of a sheet, wherein, the operation section comprises a cuttable sheet quantity input section to input a cuttable quantity of sheets as an image forming condition, and in a case where an image forming order starts with an Nth page and ends with a first page, N denoting a page quantity in the image data, if a quantity of image forming sheets in the job is within an inputted cuttable sheet quantity, the control unit performs control to form an image based on a composite image of image data and a cut guide attached to the image data only on a last image forming page; and if the quantity of image forming sheets in the job exceeds the inputted cuttable sheet quantity, the control unit performs control to:

select the sort mode;

set a quantity of shift-ejection sheets within the cuttable sheet quantity and operate the shifting unit;

shift and stack sheets onto the sheet ejection tray as sheet stacks each of which being in the quantity of shift-ejection sheets; and form an image based on a composite image of image data and a cut guide attached to the image data only on a last image forming page of each shifted sheet stack.

2. The image forming apparatus of claim 1, wherein the control unit selects the sort mode in a case where the job includes plural groups in volume unit, and if each quantity of image forming sheets of each group in volume unit is within the cuttable sheet quantity, the control unit performs control to:

shift sheets for each group in volume unit; and form an image based on a composite image of image data and a cut guide attached to the image data only on a last image forming page of each group in volume unit, and if each quantity of image forming sheets of each group in volume unit exceeds the cuttable sheet quantity, the control unit performs control to:

set a quantity of shift-ejection sheets within the cuttable sheet quantity and operate the shifting unit;

shift and stack sheets onto the sheet ejection tray as sheet stacks each of which being in the quantity of shift-ejecting sheets; and form an image based on a composite image of image data and a cut guide attached to the image data only on a last image forming page of each shift-ejecting sheet stack of each group in volume unit.

3. The image forming apparatus of claim 1, wherein the control unit selects the sort mode in a case where the job includes plural groups in page unit, and if each quantity of image forming sheets of each group in page unit is within the cuttable sheet quantity, the control unit performs control to:

shift sheets for each group in page unit; and form an image based on a composite image of image data and a cut guide attached to the image data only on a last image forming page of each group in page unit, and if each quantity of image forming sheets of each group in page unit exceeds the cuttable sheet quantity, the control unit performs control to:

set a quantity of shift-ejection sheets within the cuttable sheet quantity and operate the shifting unit;

shift and stack sheets onto the sheet ejection tray as sheet stacks each of which being in the quantity of shift-ejecting sheets; and form an image based on a composite image of image data and a cut guide attached to the image data only on a last image forming page of each shift-ejecting sheet stack of each group in page unit.

4. An image forming apparatus, comprising:

an image forming section that forms an image on a sheet, based on image data of a job;

a sheet ejection tray on which to stack sheets having been formed with an image;

a shifting unit that shifts and stacks the sheets onto the sheet ejection tray;

an operation section to set an image forming condition of the job;

a control unit to control image forming;

a sort mode to operate the shifting unit;

a double sided mode to form an image on both sides of a sheet; and a single sided mode to form an image on a single side of a sheet, wherein, the operation section comprises a cuttable sheet quantity input section to input a cuttable quantity of sheets as an image forming condition, and in a case where an image forming order starts with a first page and ends with an Nth page, N denoting a page quantity in the image data, if a quantity of image forming sheets in the job is within an inputted cuttable sheet quantity, the control unit performs control to form an image based on a composite image of image data and a cut guide attached to the image data only on a first image forming page; and if the quantity of image forming sheets in the job exceeds the inputted cuttable sheet quantity, the control unit performs control to:

select the sort mode;

set a quantity of shift-ejection sheets within the cuttable sheet quantity and operate the shifting unit;

shift and stack sheets onto the sheet ejection tray as sheet stacks each of which being in the quantity of shift-ejection sheets; and form an image based on a composite image of image data and a cut guide attached to the image data only on a first image forming page of each shifted sheet stack.

5. The image forming apparatus of claim 4, wherein the control unit selects the sort mode in a case where the job includes plural groups in volume unit, and if each quantity of image forming sheets of each group in volume unit is within the cuttable sheet quantity, the control unit performs control to:

shift sheets for each group in volume unit; and form an image based on a composite image of image data and a cut guide attached to the image data only on a first image forming page of each group in volume unit, and if each quantity of image forming sheets of each group in volume unit exceeds the cuttable sheet quantity, the control unit performs control to:

set a quantity of shift-ejection sheets within the cuttable sheet quantity and operate the shifting unit;

shift and stack sheets onto the sheet ejection tray as sheet stacks each of which being in the quantity of shift-ejecting sheets; and form an image based on a composite image of image data and a cut guide attached to the image data only on a first image forming page of each shift-ejecting sheet stack of each group in volume unit.

6. The image forming apparatus of claim 4, wherein the control unit selects the sort mode in a case where the job includes plural groups in page unit, and if each quantity of image forming sheets of each group in page unit is within the cuttable sheet quantity, the control unit performs control to:

shift sheets for each group in page unit; and form an image based on a composite image of image data and a cut guide attached to the image data only on a first image forming page of each group in page unit, and if each quantity of image forming sheets of each group in page unit exceeds the cuttable sheet quantity, the control unit performs control to:

set a quantity of shift-ejection sheets within the cuttable sheet quantity and operate the shifting unit;

shift and stack sheets onto the sheet ejection tray as sheet stacks each of which being in the quantity of shift-ejecting sheets; and form an image based on a composite image of image data and a cut guide attached to the image data only on a first image forming page of each shift-ejecting sheet stack of each group in page unit.

* * * * *